US011297876B2

(12) United States Patent
Brinkley et al.

(10) Patent No.: US 11,297,876 B2
(45) Date of Patent: Apr. 12, 2022

(54) AEROSOL DELIVERY DEVICE

(71) Applicant: RAI Strategic Holdings, Inc., Winston-Salem, NC (US)

(72) Inventors: Paul Andrew Brinkley, Winston-Salem, NC (US); Charles Jacob Novak, III, Winston-Salem, NC (US); Alfred Charles Bless, Asheboro, NC (US)

(73) Assignee: RAI Strategic Holdings, Inc., Winston-Salem, NC (US)

( * ) Notice: Subject to any disclaimer, the term of this patent is extended or adjusted under 35 U.S.C. 154(b) by 61 days.

(21) Appl. No.: 15/597,537

(22) Filed: May 17, 2017

(65) Prior Publication Data

US 2017/0273360 A1 Sep. 28, 2017

(51) Int. Cl.

| | |
|---|---|
| ***A24F 47/00*** | (2020.01) |
| ***A24F 7/00*** | (2006.01) |
| ***A24F 40/40*** | (2020.01) |
| ***A24F 40/70*** | (2020.01) |
| *A24F 40/10* | (2020.01) |

(52) U.S. Cl.

CPC ..... *A24F 7/00* (2013.01); *A24F 40/40* (2020.01); *A24F 40/70* (2020.01); *A24F 40/10* (2020.01)

(58) Field of Classification Search

CPC ..... A41D 31/0077; B29K 2995/0093; B29L 2031/7414; A24F 7/00; A24F 7/04; A24F 40/10; A24F 40/40; A24F 40/42; A24F 40/70; A24D 3/00; A24D 3/06; A24D 3/063; A24D 3/065; A24D 3/066; A24D 3/067; A24D 3/08; A24D 3/10; A24D 3/18

See application file for complete search history.

(56) References Cited

U.S. PATENT DOCUMENTS

| | | | | |
|---|---|---|---|---|
| 1,771,366 A | | 7/1930 | Wyss et al. | |
| 2,057,353 A | | 10/1936 | Whittemore, Jr. | |
| 2,104,266 A | | 1/1938 | McCormick | |
| 3,200,819 A | | 8/1965 | Gilbert | |
| 4,284,089 A | | 8/1981 | Ray | |
| 4,303,083 A | | 12/1981 | Burruss, Jr. | |
| 4,366,826 A | * | 1/1983 | Horsewell ..... | A24D 3/08 131/336 |
| 4,735,217 A | | 4/1988 | Gerth et al. | |

(Continued)

FOREIGN PATENT DOCUMENTS

| | | |
|---|---|---|
| AU | 276250 | 7/1965 |
| CA | 2 641 869 | 5/2010 |

(Continued)

OTHER PUBLICATIONS

Sanjay S. Latthe et al.,"Superhydrophobic Surfaces Developed by Mimicking Hierarchical Surface Morphology of Lotus Leaf", Molecules, Apr. 4, 2014, vol. 19, ISSN 1420-3049, http://www.mdpi.com/1420-3049/19/4/4256/pdf, pp. 4256-4283.

(Continued)

*Primary Examiner* — Eric Yaary

(74) *Attorney, Agent, or Firm* — Womble Bond Dickinson (US) LLP

(57) ABSTRACT

An aerosol delivery device is disclosed. The aerosol delivery device includes an atomizer and a body. The body has an outlet and houses the atomizer. The aerosol delivery device also includes a structure configured to inhibit liquid droplets of an aerosol precursor from exiting the outlet. Embodiments of the structure include micro-patterned surfaces, absorbers, and macro structures to create droplet capturing chambers.

10 Claims, 12 Drawing Sheets

(56) References Cited

U.S. PATENT DOCUMENTS 4,848,374 A 7/1989 Chard et al.
4,907,606 A 3/1990 Lilja et al.
4,922,901 A 5/1990 Brooks et al.
4,945,931 A 8/1990 Gori
4,947,874 A 8/1990 Brooks et al.
4,947,875 A 8/1990 Brooks et al.
4,986,286 A 1/1991 Roberts et al.
5,019,122 A 5/1991 Clearman et al.
5,042,510 A 8/1991 Curtiss et al.
5,060,671 A 10/1991 Counts et al.
5,093,894 A 3/1992 Deevi et al.
5,144,962 A 9/1992 Counts et al.
5,249,586 A 10/1993 Morgan et al.
5,261,424 A 11/1993 Sprinkel, Jr.
5,322,075 A 6/1994 Deevi et al.
5,353,813 A 10/1994 Deevi et al.
5,369,723 A 11/1994 Counts et al.
5,372,148 A 12/1994 McCafferty et al.
5,388,574 A 2/1995 Ingebrethsen et al.
5,408,574 A 4/1995 Deevi et al.
5,468,936 A 11/1995 Deevi et al.
5,498,850 A 3/1996 Das
5,515,842 A 5/1996 Ramseyer et al.
5,530,225 A 6/1996 Hajaligol
5,564,442 A 10/1996 MacDonald et al.
5,649,554 A 7/1997 Sprinkel et al.
5,666,977 A 9/1997 Higgins et al.
5,687,746 A 11/1997 Rose et al.
5,709,227 A * 1/1998 Arzonico ..... A24D 3/068 131/331
5,726,421 A 3/1998 Fleischhauer et al.
5,727,571 A 3/1998 Meiring et al.
5,743,251 A 4/1998 Howell et al.
5,799,663 A 9/1998 Gross et al.
5,819,756 A 10/1998 Mielordt
5,865,185 A 2/1999 Collins et al.
5,865,186 A 2/1999 Volsey, II
5,878,752 A 3/1999 Adams et al.
5,894,841 A 4/1999 Voges
5,934,289 A 8/1999 Watkins et al.
5,954,979 A 9/1999 Counts et al.
5,967,148 A 10/1999 Harris et al.
6,040,560 A 3/2000 Fleischhauer et al.
6,053,176 A 4/2000 Adams et al.
6,089,857 A 7/2000 Matsuura et al.
6,095,153 A 8/2000 Kessler et al.
6,125,853 A 10/2000 Susa et al.
6,155,268 A 12/2000 Takeuchi
6,164,287 A 12/2000 White
6,196,218 B1 3/2001 Voges
6,196,219 B1 3/2001 Hess et al.
6,290,685 B1 * 9/2001 Insley ..... A61M 1/008 165/6
6,598,607 B2 7/2003 Adiga et al.
6,601,776 B1 8/2003 Oljaca et al.
6,615,840 B1 9/2003 Fournier et al.
6,688,313 B2 2/2004 Wrenn et al.
6,772,756 B2 8/2004 Shayan
6,803,545 B2 10/2004 Blake et al.
6,854,461 B2 2/2005 Nichols
6,854,470 B1 2/2005 Pu
6,997,244 B2 * 2/2006 Hui-Chun ..... F28D 15/046 165/104.26
7,117,867 B2 10/2006 Cox et al.
7,293,565 B2 11/2007 Griffin et al.
7,513,253 B2 4/2009 Kobayashi et al.
7,775,459 B2 8/2010 Martens, III et al.
7,832,410 B2 11/2010 Hon
7,845,359 B2 12/2010 Montaser
7,896,006 B2 3/2011 Hamano et al.
8,127,772 B2 3/2012 Montaser
8,314,591 B2 11/2012 Terry et al.
8,365,742 B2 2/2013 Hon
8,402,976 B2 3/2013 Fernando et al.
8,499,766 B1 8/2013 Newton
8,528,569 B1 9/2013 Newton
8,550,069 B2 10/2013 Alelov
8,851,081 B2 10/2014 Fernando et al.
8,895,438 B2 * 11/2014 Peter ..... G03F 7/0002 264/293
8,997,672 B2 4/2015 Brennan et al.
9,198,462 B2 * 12/2015 Ghanavi ..... A24D 3/063
9,220,302 B2 12/2015 DePiano et al.
9,427,908 B2 * 8/2016 Low ..... B29C 59/022
9,908,274 B2 * 3/2018 Hulseman ..... B21C 23/06
2002/0146242 A1 10/2002 Vieira
2003/0096083 A1 * 5/2003 Morgan ..... B05D 5/08 428/141
2003/0226837 A1 12/2003 Blake et al.
2004/0118401 A1 6/2004 Smith et al.
2004/0129280 A1 7/2004 Woodson et al.
2004/0200488 A1 10/2004 Felter et al.
2004/0226568 A1 * 11/2004 Takeuchi ..... A24B 15/16 131/194
2005/0003146 A1 * 1/2005 Spath ..... A63C 5/04 428/105
2005/0016550 A1 1/2005 Katase
2005/0077030 A1 * 4/2005 Wong ..... F28D 15/043 165/104.26
2005/0170098 A1 * 8/2005 Baumann ..... B08B 17/06 427/372.2
2005/0181195 A1 * 8/2005 Dubrow ..... B05D 1/185 428/297.4
2005/0252508 A1 * 11/2005 Koerner ..... A61M 15/0065 128/200.14
2006/0016453 A1 1/2006 Kim
2006/0024504 A1 * 2/2006 Nelson ..... B29C 59/16 428/409
2006/0196518 A1 9/2006 Hon
2006/0292345 A1 * 12/2006 Dave ..... C03C 17/001 428/141
2007/0074734 A1 4/2007 Braunshteyn et al.
2007/0102013 A1 5/2007 Adams et al.
2007/0157839 A1 * 7/2007 Kim ..... G02B 5/003 101/483
2007/0202258 A1 8/2007 Yamagata et al.
2007/0215167 A1 9/2007 Crooks et al.
2007/0231542 A1 * 10/2007 Deng ..... B08B 17/06 428/141
2008/0085103 A1 4/2008 Beland et al.
2008/0092912 A1 4/2008 Robinson et al.
2008/0118772 A1 * 5/2008 Doye ..... B08B 17/06 428/689
2008/0257367 A1 10/2008 Paterno et al.
2008/0276947 A1 * 11/2008 Martzel ..... A24F 47/008 131/273
2008/0302374 A1 12/2008 Wengert et al.
2009/0011222 A1 * 1/2009 Xiu ..... C23C 18/00 428/323
2009/0095311 A1 4/2009 Hon
2009/0095312 A1 4/2009 Herbrich et al.
2009/0126745 A1 5/2009 Hon
2009/0188490 A1 7/2009 Hon
2009/0230117 A1 9/2009 Fernando et al.
2009/0272379 A1 11/2009 Thorens et al.
2009/0283103 A1 11/2009 Nielsen et al.
2009/0320863 A1 12/2009 Fernando et al.
2010/0043809 A1 2/2010 Magnon
2010/0083959 A1 4/2010 Siller
2010/0126404 A1 5/2010 Brennan et al.
2010/0200006 A1 8/2010 Robinson et al.
2010/0229881 A1 9/2010 Hearn
2010/0242974 A1 9/2010 Pan
2010/0307518 A1 12/2010 Wang
2010/0313901 A1 12/2010 Fernando et al.
2011/0005535 A1 1/2011 Xiu
2011/0011396 A1 1/2011 Fang
2011/0036363 A1 2/2011 Urtsev et al.
2011/0036365 A1 2/2011 Chong et al.
2011/0094523 A1 4/2011 Thorens et al.
2011/0126848 A1 6/2011 Zuber et al.
2011/0155153 A1 6/2011 Thorens et al.
2011/0155718 A1 6/2011 Greim et al.

(56) References Cited

U.S. PATENT DOCUMENTS

2011/0168194 A1 7/2011 Hon
2011/0229667 A1* 9/2011 Jin ..... B81C 1/00206 428/34.1
2011/0265806 A1 11/2011 Alarcon et al.
2011/0275912 A1* 11/2011 Boyden ..... A61L 2/0011 600/309
2011/0277780 A1 11/2011 Terry et al.
2011/0287203 A1* 11/2011 Victor ..... B29C 37/0053 428/36.9
2011/0309157 A1 12/2011 Yang et al.
2012/0000480 A1* 1/2012 Sebastian ..... A24D 3/064 131/332
2012/0034390 A1 2/2012 Suh et al.
2012/0042885 A1* 2/2012 Stone ..... A24B 15/165 131/194
2012/0060853 A1 3/2012 Robinson et al.
2012/0111347 A1 5/2012 Hon
2012/0132643 A1 5/2012 Choi et al.
2012/0227752 A1 9/2012 Alelov
2012/0231464 A1 9/2012 Yu et al.
2012/0260927 A1 10/2012 Liu
2012/0279512 A1 11/2012 Hon
2012/0318882 A1 12/2012 Abehasera
2013/0037041 A1 2/2013 Worm et al.
2013/0056013 A1 3/2013 Terry et al.
2013/0081625 A1 4/2013 Rustad et al.
2013/0081642 A1 4/2013 Safari
2013/0192619 A1 8/2013 Tucker et al.
2013/0255702 A1 10/2013 Griffith, Jr. et al.
2013/0306064 A1* 11/2013 Thorens ..... A24F 47/008 128/202.21
2013/0306065 A1 11/2013 Thorens et al.
2013/0306084 A1 11/2013 Flick
2013/0319439 A1 12/2013 Gorelick et al.
2013/0340750 A1 12/2013 Thorens et al.
2013/0340775 A1 12/2013 Juster et al.
2014/0000638 A1 1/2014 Sebastian et al.
2014/0060554 A1 3/2014 Collett et al.
2014/0060555 A1 3/2014 Chang et al.
2014/0096781 A1 4/2014 Sears et al.
2014/0096782 A1 4/2014 Ampolini et al.
2014/0109921 A1 4/2014 Chen
2014/0157583 A1 6/2014 Ward et al.
2014/0209105 A1 7/2014 Sears et al.
2014/0253144 A1 9/2014 Novak et al.
2014/0261408 A1 9/2014 DePiano et al.
2014/0261486 A1 9/2014 Potter et al.
2014/0261487 A1 9/2014 Chapman et al.
2014/0261492 A1* 9/2014 Kane ..... A24F 47/008 131/328
2014/0261495 A1 9/2014 Novak, III et al.
2014/0270727 A1 9/2014 Ampolini et al.
2014/0270729 A1 9/2014 DePiano et al.
2014/0270730 A1 9/2014 DePiano et al.
2014/0283859 A1* 9/2014 Minskoff ..... A24F 47/008 131/329
2014/0342121 A1* 11/2014 Taguchi ..... G02B 1/105 428/141
2014/0345631 A1 11/2014 Bowen et al.
2015/0007838 A1 1/2015 Fernando et al.
2015/0027456 A1* 1/2015 Janardhan ..... A24F 47/008 131/328
2015/0053217 A1 2/2015 Steingraber et al.
2015/0114411 A1* 4/2015 Buchberger ..... A61M 11/041 131/329
2015/0136158 A1* 5/2015 Stevens ..... A24F 47/008 131/329
2015/0181928 A1 7/2015 Liu
2015/0231821 A1* 8/2015 Heiskanen ..... B29C 59/022 428/211.1
2015/0251201 A1* 9/2015 Hradetzky ..... A61M 11/00 239/690
2016/0000149 A1 1/2016 Scatterday
2016/0037826 A1 2/2016 Hearn et al.
2016/0052177 A1* 2/2016 Chauvin ..... B29C 49/12 264/524
2016/0121057 A1* 5/2016 Dyche ..... B05B 1/08 128/200.23
2016/0228658 A1* 8/2016 Minskoff ..... A61M 15/02
2016/0229095 A1* 8/2016 Mori ..... G02B 1/118
2016/0270442 A1 9/2016 Liu
2016/0271347 A1* 9/2016 Raichman ..... A61M 15/06
2017/0042243 A1* 2/2017 Plojoux ..... A24F 47/008
2017/0050343 A1* 2/2017 Wei ..... B29C 33/3892
2017/0136660 A1* 5/2017 Heilmann ..... B29C 33/3842
2017/0144202 A1* 5/2017 King ..... B08B 17/065
2017/0309364 A1* 10/2017 Yamada ..... H01B 1/22
2017/0311452 A1* 10/2017 Ho ..... H05K 3/1258
2017/0312458 A1* 11/2017 Beller ..... A61M 15/0008
2017/0367402 A1* 12/2017 Lau ..... A24F 47/008

FOREIGN PATENT DOCUMENTS

| | | | |
|---|---|---|---|
| CN | 2571179 | | 9/2003 |
| CN | 1541577 | | 11/2004 |
| CN | 2719043 | | 8/2005 |
| CN | 200997909 | | 1/2008 |
| CN | 101116542 | | 2/2008 |
| CN | 101176805 | | 5/2008 |
| CN | 201379072 | | 1/2010 |
| CN | 201767029 | | 3/2011 |
| CN | 103504481 | | 1/2014 |
| CN | 203884697 | | 10/2014 |
| CN | 105982363 | | 10/2016 |
| CN | 106418721 | | 2/2017 |
| CN | 205947125 | | 2/2017 |
| DE | 10 2006 004 484 | | 8/2007 |
| DE | 102006041042 | | 3/2008 |
| DE | 20 2009 010 400 | | 11/2009 |
| EP | 0 295 122 | | 12/1988 |
| EP | 0 430 566 | | 6/1991 |
| EP | 0 845 220 | | 6/1998 |
| EP | 1 618 803 | | 1/2006 |
| EP | 2 187 263 | | 5/2010 |
| EP | 2 316 286 | | 5/2011 |
| EP | 2 460 422 | A1 | 6/2012 |
| GB | 2469850 | | 11/2010 |
| RU | 2564611 | | 10/2015 |
| WO | WO 1997/48293 | | 12/1997 |
| WO | WO 2003/034847 | | 5/2003 |
| WO | WO 2004/043175 | | 5/2004 |
| WO | WO 2004/080216 | | 9/2004 |
| WO | WO 2005/099494 | | 10/2005 |
| WO | WO 2007/078273 | | 7/2007 |
| WO | WO 2007/131449 | | 11/2007 |
| WO | WO 2009/105919 | | 9/2009 |
| WO | WO 2009/155734 | | 12/2009 |
| WO | WO 2010/003480 | | 1/2010 |
| WO | WO 2010/045670 | | 4/2010 |
| WO | WO 2010/073122 | | 7/2010 |
| WO | WO 2010/118644 | | 10/2010 |
| WO | WO 2010/140937 | | 12/2010 |
| WO | WO 2011/010334 | | 1/2011 |
| WO | WO 2011/094344 | | 8/2011 |
| WO | 2011/117580 | A2 | 9/2011 |
| WO | WO 2012/072762 | | 6/2012 |
| WO | WO 2012/100523 | | 8/2012 |
| WO | WO 2013/089551 | | 6/2013 |
| WO | WO 2015/013329 | | 1/2015 |
| WO | WO 2015/189623 | | 12/2015 |
| WO | WO 2016/042409 | | 3/2016 |
| WO | WO 2016/079155 | | 5/2016 |

OTHER PUBLICATIONS

S. Lee et al., "Artificial Lotus Leaf Structures Made by Blasting with Sodium Bicarbonate", 18th International Conference on Composite Materials, http://www.iccm-central.org/Proceedings/ICCM18proceedings/data/2.%20Oral%20Presentation/Aug22%28M.

(56) References Cited

OTHER PUBLICATIONS

"The Technology of Sharklet", Sharklet Technologies, Inc., http://sharklet.com/our-technology/technology-overview/, pp. 1-2, Retrieved Mar. 25, 2016.
International Search Report dated Jun. 29, 2017 in corresponding application No. PCT/IB2017/051699 filed Mar. 23, 2017.
Koch, K. et al., "Diversity of structure, morphology and wetting of plant surfaces," *Soft Matter*, 2008, vol. 4, pp. 1943-1963.
Koch, K. et al., "Multifunctional surface structures of plants: An inspiration for biomimetics," *Progress in Materials Science*, 2009, vol. 54, pp. 137-178.
Vincent, Julian F. V. et al., "Biomimetics: its practice and theory," Journal of the Royal Society, Interface vol. 3,9 (2006): 471-82. doi: 10.1098/rsif.2006.0127 (Year: 2006).

* cited by examiner

AEROSOL DELIVERY DEVICE

FIELD OF THE DISCLOSURE

The present disclosure relates to aerosol delivery devices such as electronic cigarettes, and more particularly to aerosol delivery devices including an atomizer. The atomizer may be configured to heat an aerosol precursor composition, which may be made or derived from tobacco or otherwise incorporate tobacco, to form an inhalable substance for human consumption.

BACKGROUND

Many smoking devices have been proposed through the years as improvements upon, or alternatives to, smoking products that require combusting tobacco for use. Many of those devices purportedly have been designed to provide the sensations associated with cigarette, cigar, or pipe smoking, but without delivering considerable quantities of incomplete combustion and pyrolysis products that result from the burning of tobacco. To this end, there have been proposed numerous smoking products, flavor generators, and medicinal inhalers that utilize electrical energy to vaporize or heat a volatile material, or attempt to provide the sensations of cigarette, cigar, or pipe smoking without burning tobacco to a significant degree. See, for example, the various alternative smoking articles, aerosol delivery devices and heat generating sources set forth in the background art described in U.S. Pat. No. 8,881,737 to Collett et al., U.S. Pat. App. Pub. No. 2013/0255702 to Griffith Jr. et al., U.S. Pat. App. Pub. No. 2014/0000638 to Sebastian et al., U.S. Pat. App. Pub. No. 2014/0096781 to Sears et al., U.S. Pat. App. Pub. No. 2014/0096782 to Ampolini et al., and U.S. Pat. App. Pub. No. 2015/0059780 to Davis et al., which are incorporated herein by reference in their entireties. See also, for example, the various embodiments of products and heating configurations described in the background sections of U.S. Pat. No. 5,388,594 to Counts et al. and U.S. Pat. No. 8,079,371 to Robinson et al., which are incorporated by reference in their entireties.

Usage of aerosol delivery devices involves inhaling aerosol produced by the aerosol delivery device. A user typically places the aerosol delivery device against his or her lips to draw on the aerosol delivery device and receive the aerosol. However, such usage may lead to drawing liquid droplets of aerosol precursor from the aerosol delivery device that has either condensed or was not fully volatilized or vaporized. Accordingly, it may be desirable to provide the aerosol delivery device with features configured to resist liquid aerosol precursor from leaving the mouth end of the aerosol delivery device, an issue sometimes referred to as liquid carry over.

SUMMARY OF THE DISCLOSURE

Embodiments of the present disclosure relate to an aerosol delivery device comprising an atomizer, and a body. The body has an outlet and houses the atomizer. The aerosol delivery device further comprises a structure configured to inhibit liquid droplets of an aerosol precursor from exiting the outlet.

In some embodiments, the structure configured to inhibit the exit of droplets includes a micro-pattern applied to a surface of the body, such as the inner surface of a mouthpiece. In some instances, the micro-pattern is configured to make the surface hydrophobic. In some instances, the micro-pattern is configured to entrap the liquid droplets along the surface. In an embodiment, the micro-pattern comprises a plurality of capillary channels. In an embodiment, the micro-pattern is formed by etching.

In some embodiment, the structure configured to inhibit the exit of droplets includes an absorptive component formed from cellulose acetate combined with wood pulp and a polyvinyl alcohol (PVA) binder disposed within a mouthpiece.

In other embodiments, the structure configured to inhibit the exit of droplets includes features configured to create droplet trapping chambers. In an embodiment, a mouthpiece comprises a plurality of fins extending from an inner surface thereof and forming grooves therebetween. In an embodiment, the mouthpiece comprises a plurality of flutes shaped and arranged to form a ring concentric with an inner surface of the mouthpiece. In a further embodiment, the mouthpiece comprises an invert extending inwardly from the outlet, and spaced from an inner surface of the mouthpiece.

The present disclosure also includes methods of forming an aerosol delivery device. An embodiment of the method includes providing an aerosol precursor composition, positioning an atomizer in fluid communication with the aerosol precursor composition, and assembling the atomizer with a body. The body has an outlet. The body is configured to minimize an ability of liquid droplets of the aerosol precursor to exit the outlet.

In certain embodiments, forming the body includes providing a micro-pattern. In one embodiment, the micro-pattern comprises capillary channels. In some embodiments, forming the body comprises molding the body, and may further comprise etching a mold.

The present disclosure also includes methods of minimizing waste of an aerosol precursor composition during use of an aerosol delivery device. The method according to one embodiment comprises drawing air past an atomizer and out of the aerosol delivery device through an outlet of a mouthpiece when the atomizer is in fluid connection with the aerosol precursor. The method further comprises inhibiting droplets of the aerosol precursor composition from exiting the outlet of the mouthpiece.

In one embodiment, inhibiting the droplets from exiting comprises limiting droplet accumulation with a micro-patterned surface configured to be hydrophobic. In another embodiment, inhibiting the droplets from exiting comprises entrapping droplets on a micro-patterned surface.

These and other features, aspects, and advantages of the disclosure will be apparent from a reading of the following detailed description together with the accompanying drawings, which are briefly described below.

BRIEF DESCRIPTION OF THE FIGURES

Figure 1:
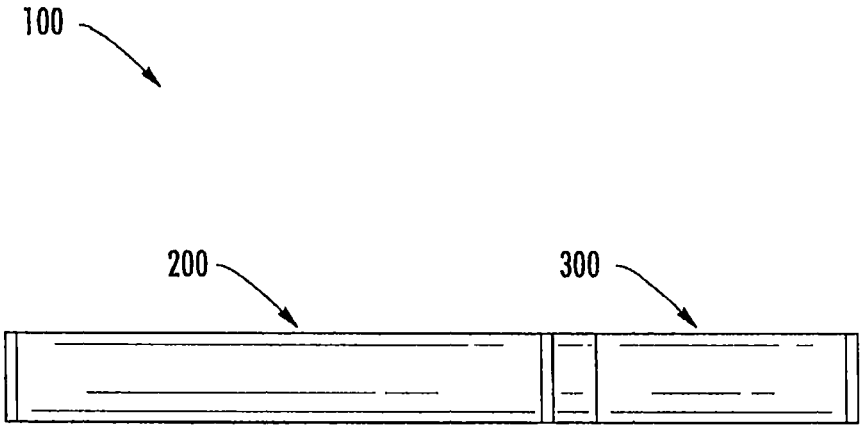
Figure 2:
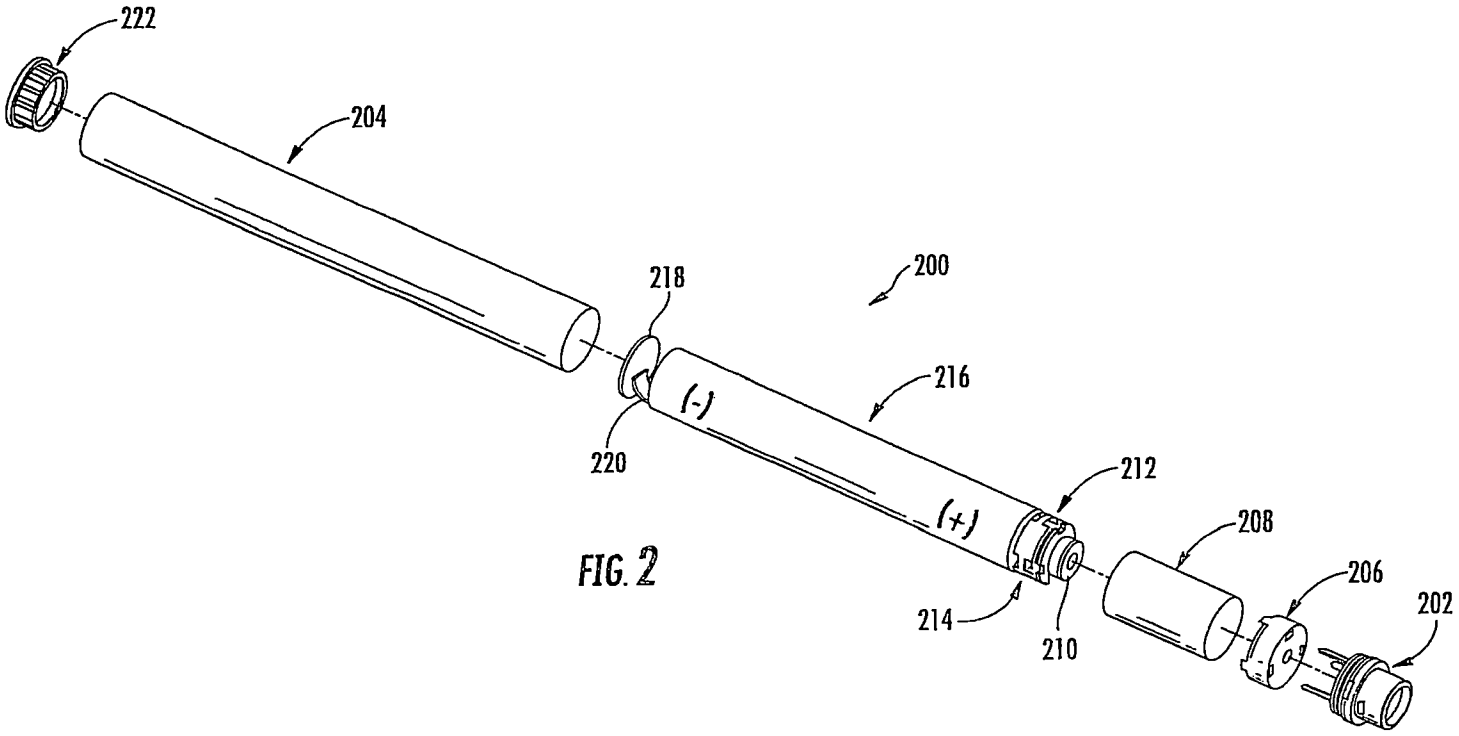
Figure 3:
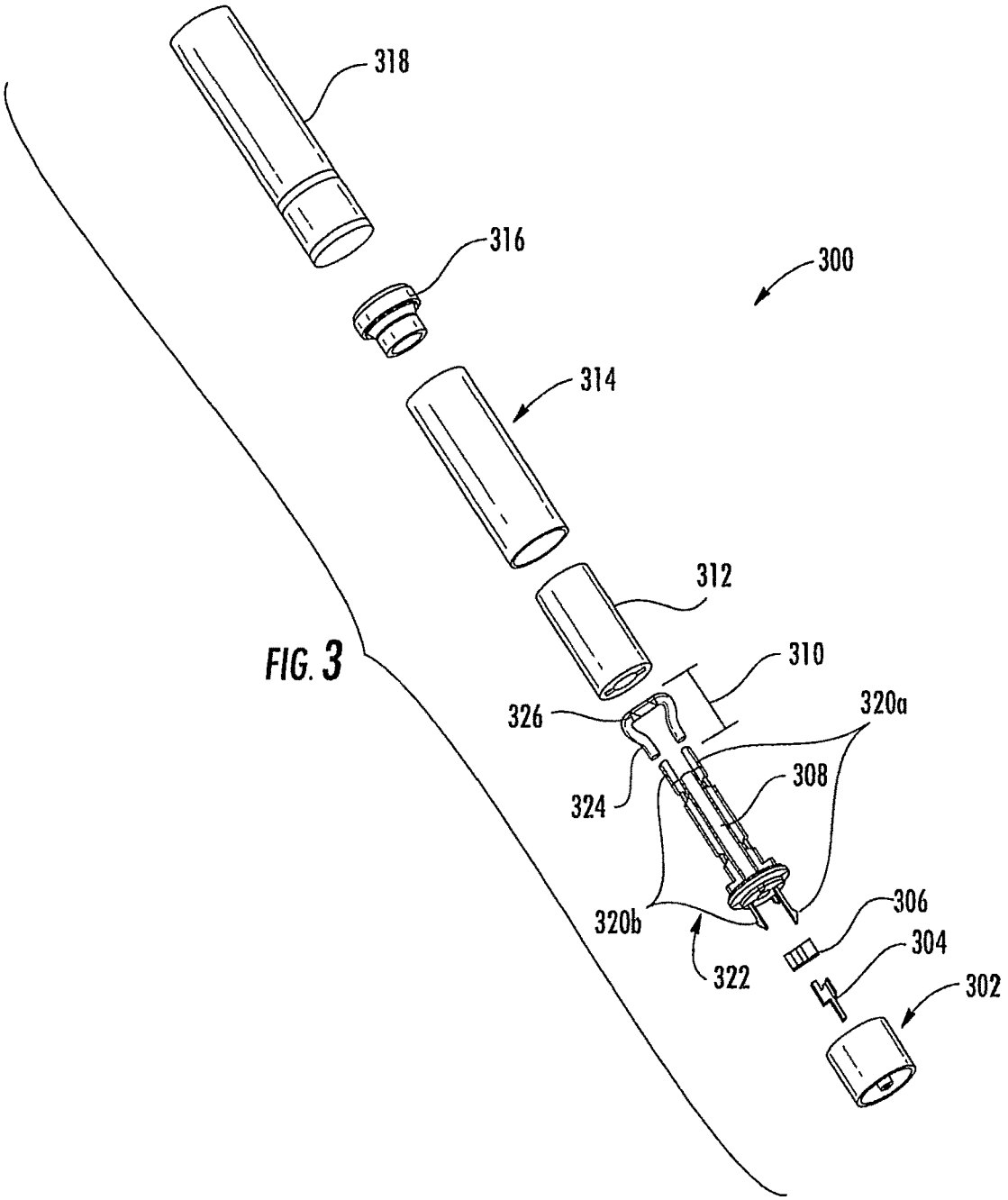
Figure 4:
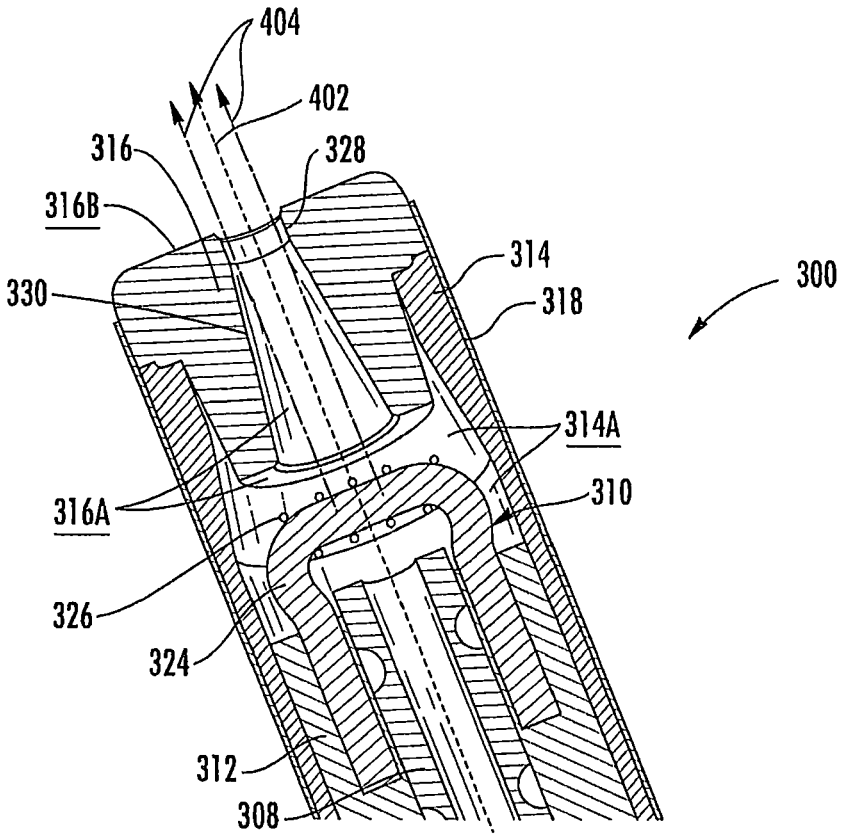
Figure 5:
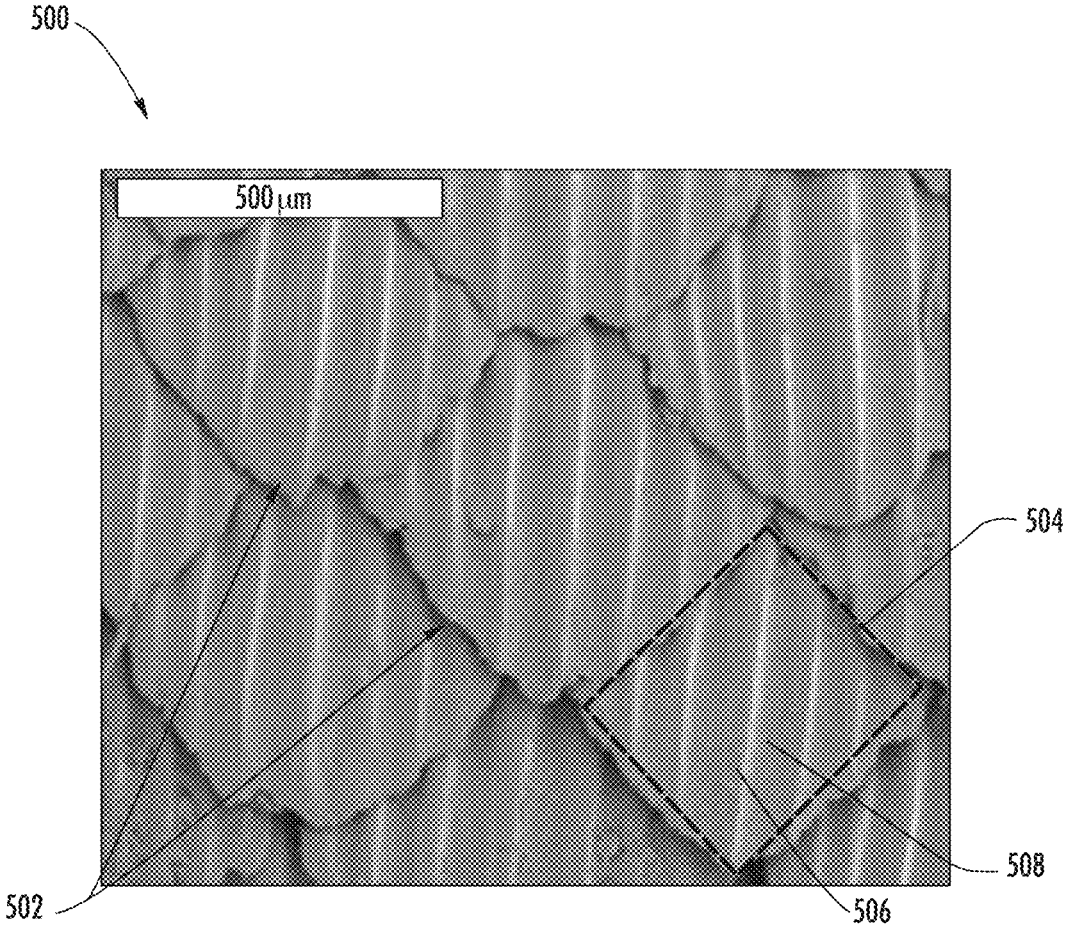
Figure 6:
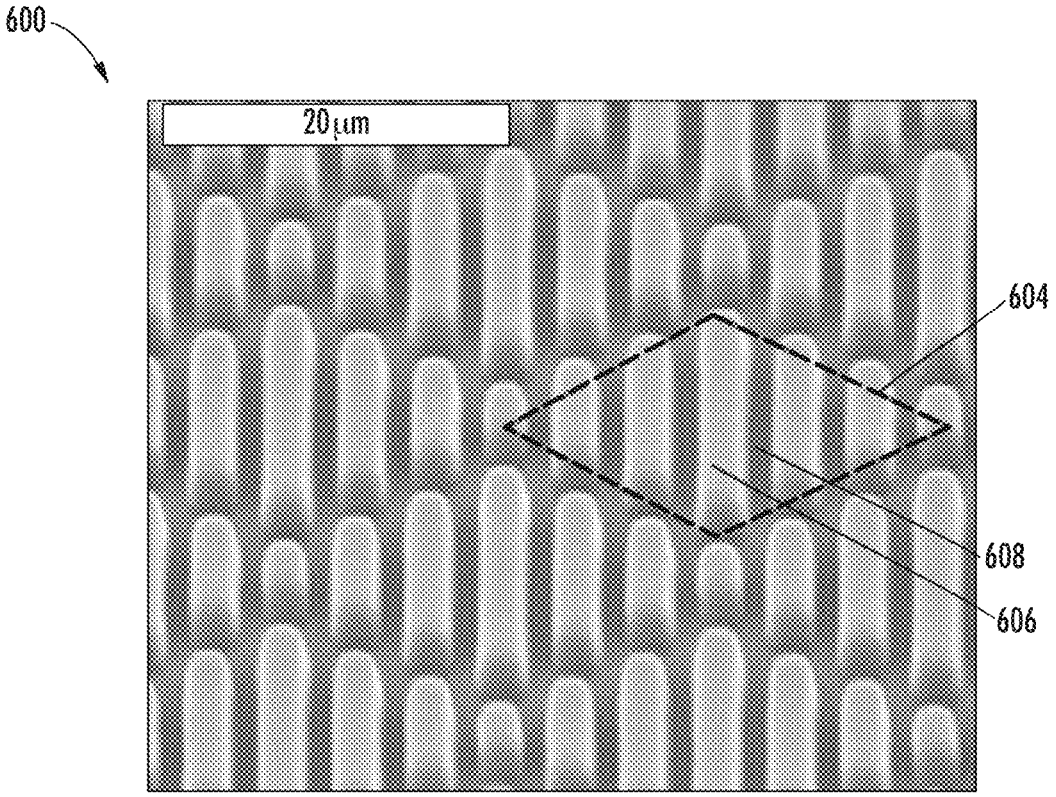
Figure 7:
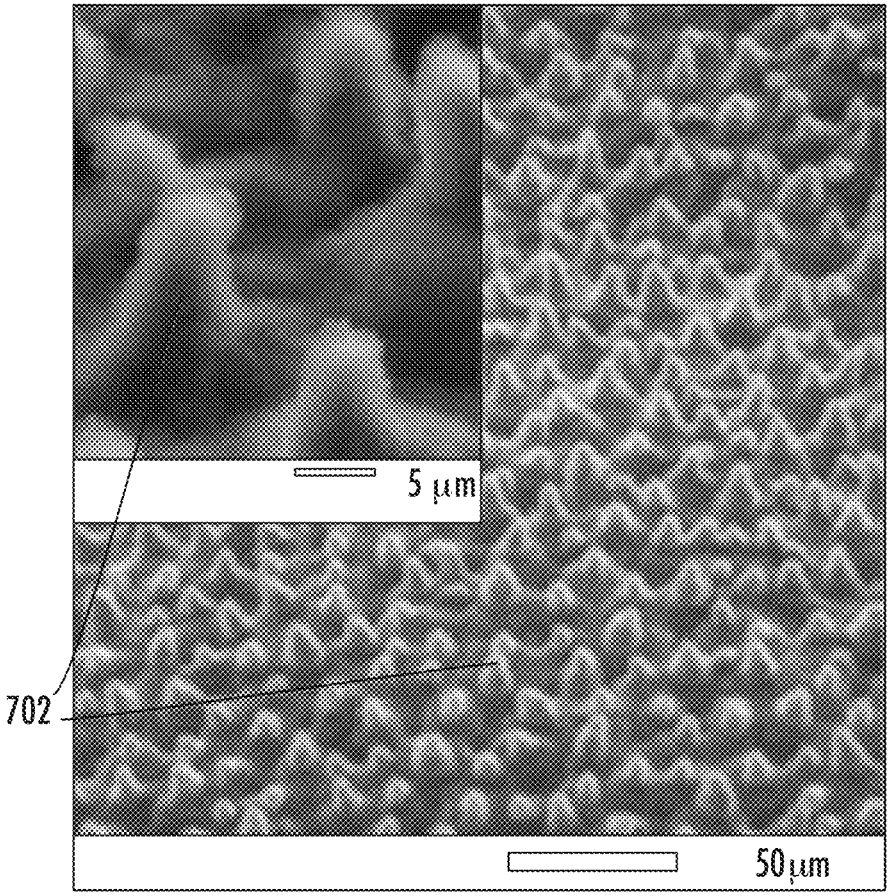
Figure 8:
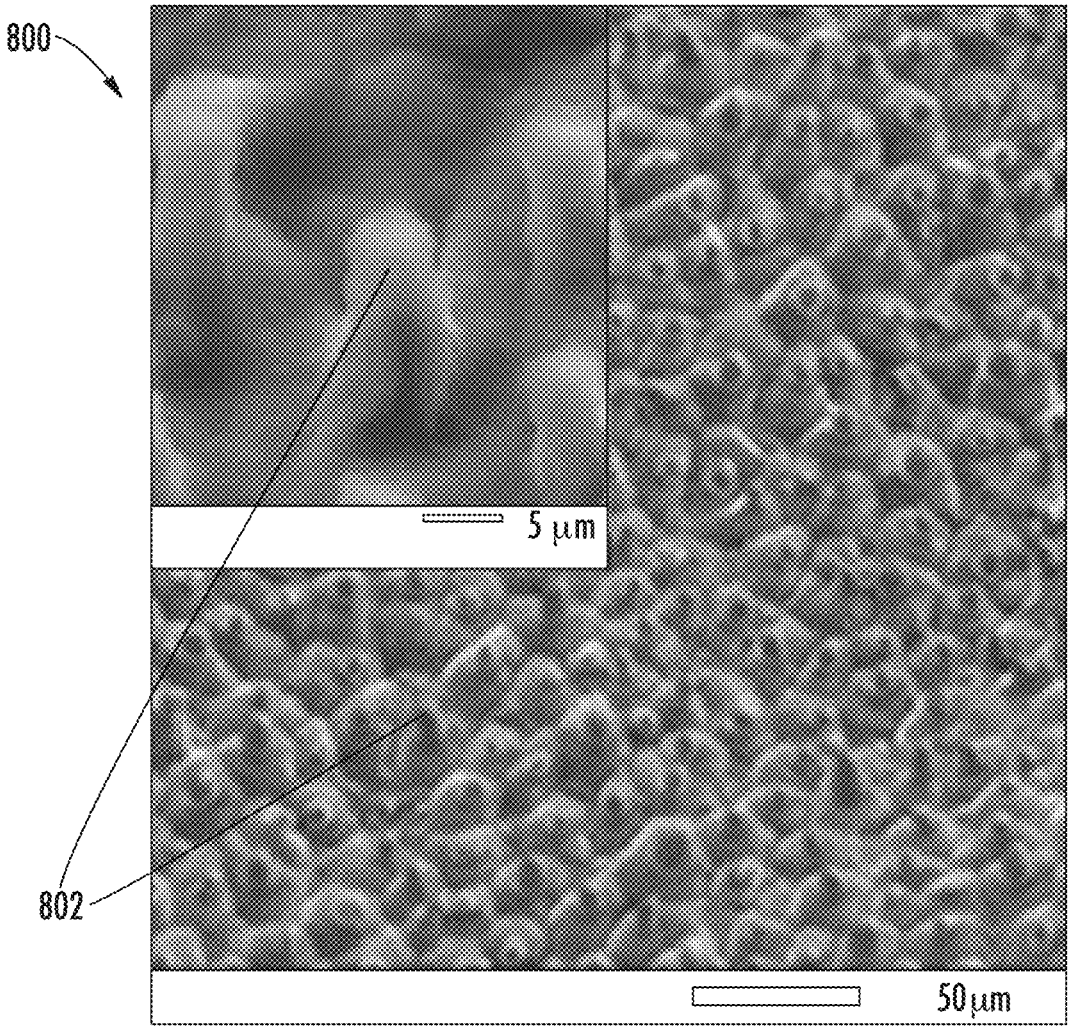
Figure 9:
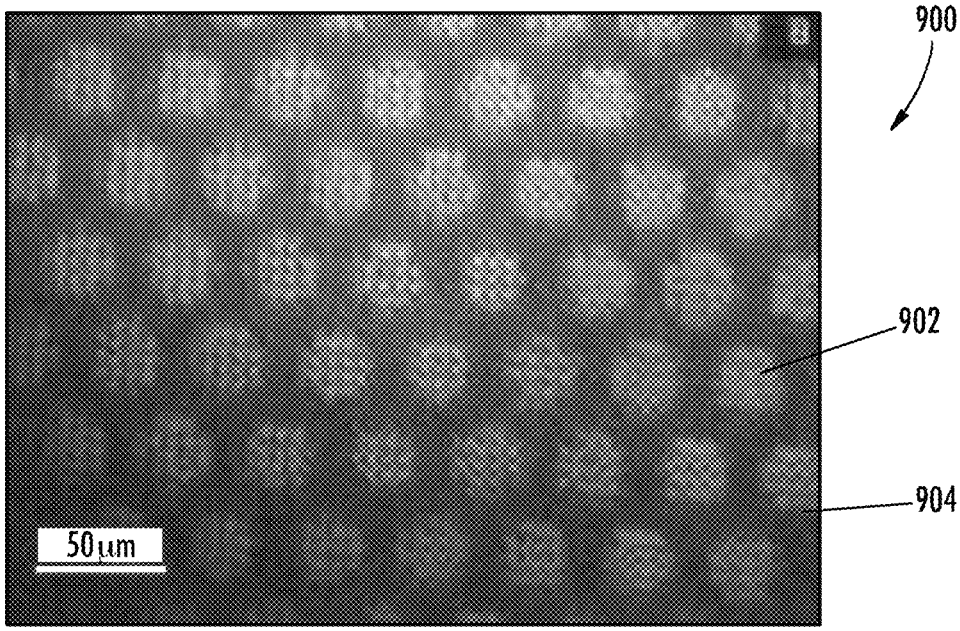

Having thus described the disclosure in the foregoing general terms, reference will now be made to the accompanying drawings, which are not necessarily drawn to scale, and wherein:

FIG. 1 illustrates a side view of an aerosol delivery device comprising a cartridge and a control body in an assembled configuration according to an example embodiment of the present disclosure;

FIG. 2 illustrates the control body of FIG. 1 in an exploded configuration according to an example embodiment of the present disclosure;

FIG. 3 illustrates the cartridge of FIG. 1 in an exploded configuration according to an example embodiment of the present disclosure;

FIG. 4 illustrates a partial sectional view through the cartridge of FIG. 1 according to an example embodiment of the present disclosure;

FIG. 5 illustrates a microscopic image of sharkskin;

FIG. 6 illustrates a microscopic image of a surface including a sharkskin micro-pattern according to an example embodiment of the present disclosure;

FIG. 7 illustrates scanning electron microscopic images of a lotus leaf;

FIG. 8 illustrates scanning electron microscopic images of a surface including a lotus leaf micro-pattern according to an example embodiment of the present disclosure;

FIG. 9 illustrates a microscopic image of a micro-patterned surface according to another example embodiment of the present disclosure.

Figure 10:
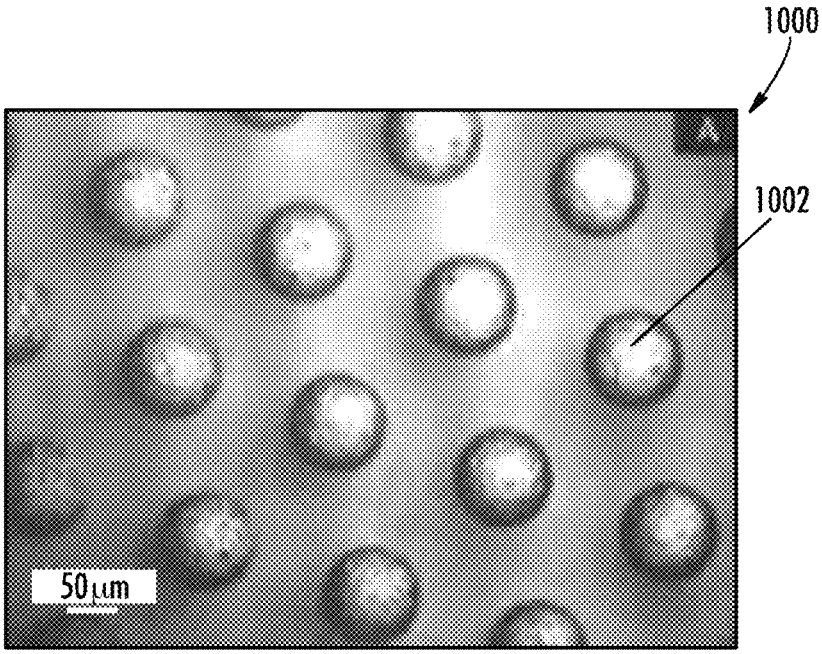

FIG. 10 illustrates a microscopic image of a micro-patterned surface according to another example embodiment of the present disclosure.

Figure 11:
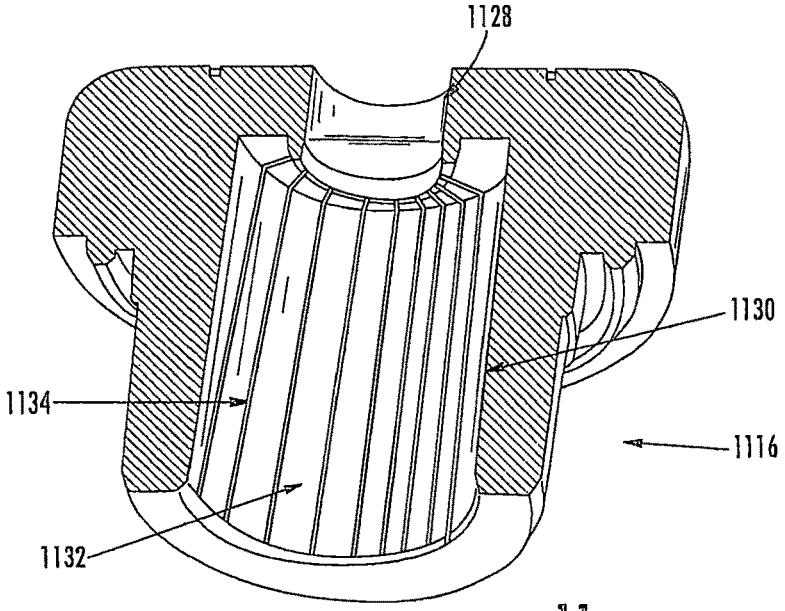

FIG. 11 illustrates a cross section of a mouthpiece according to an example embodiment with a micro-patterned surface.

Figure 12:
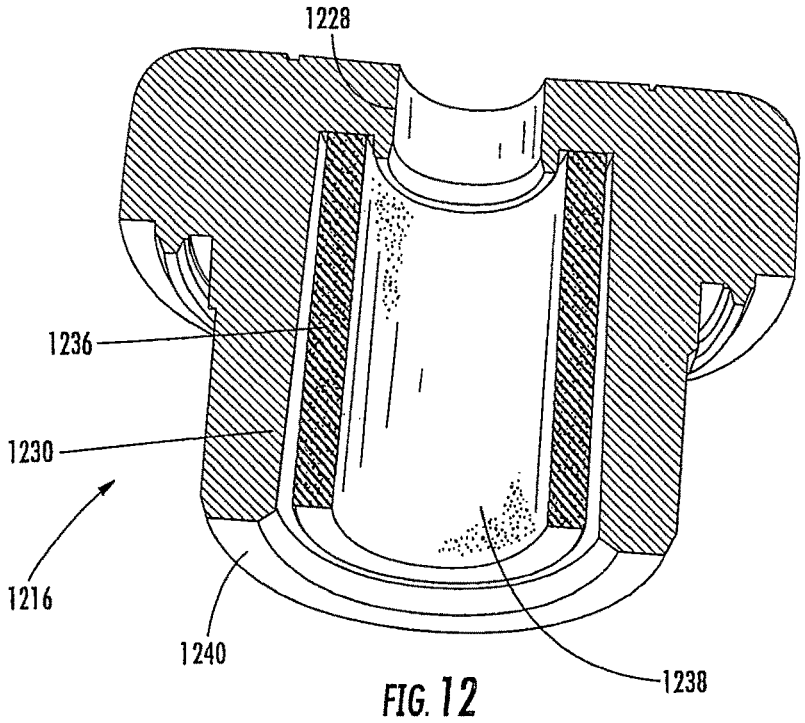

FIG. 12 illustrates a cross section of another mouthpiece according to an example embodiment with an absorptive component.

Figure 13:
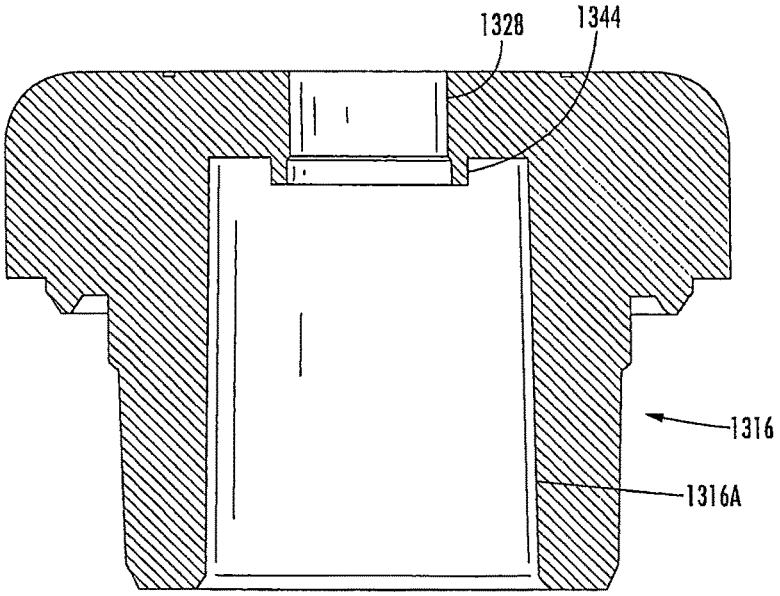

FIG. 13 illustrates a cross section of another mouthpiece according to an example embodiment suitable for including a micro-pattern.

Figure 14:
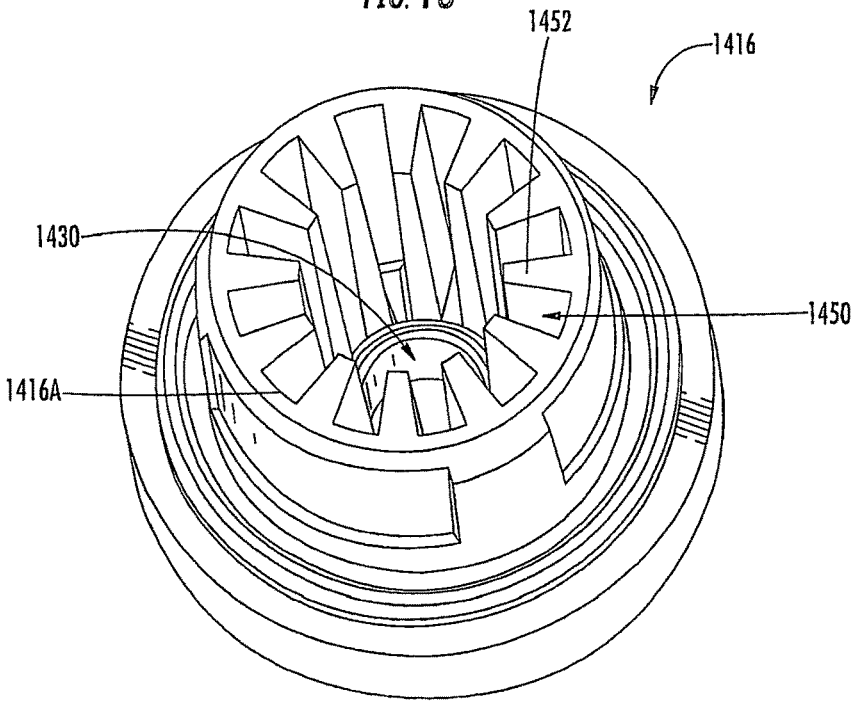

FIG. 14 illustrates a mouthpiece with a plurality of fins and intervening groove configured to control flow of condensed aerosol precursor according to another example embodiment of the present disclosure.

Figure 15:
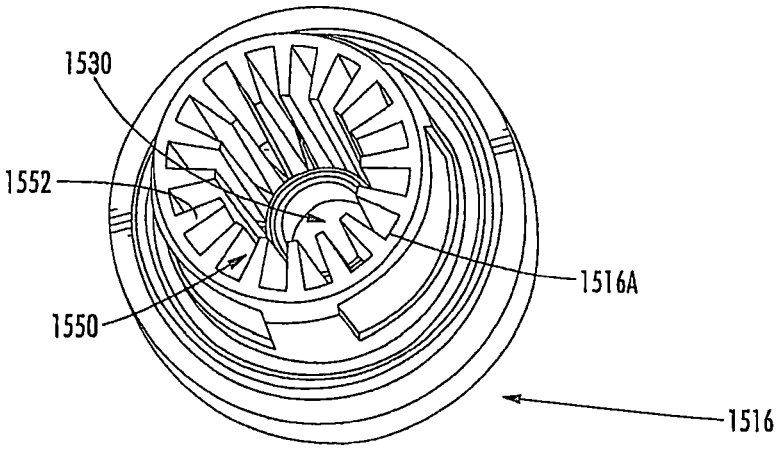

FIG. 15 illustrates a mouthpiece with a plurality of fins and intervening groove configured to control flow of condensed aerosol precursor according to another example embodiment of the present disclosure.

Figure 16:
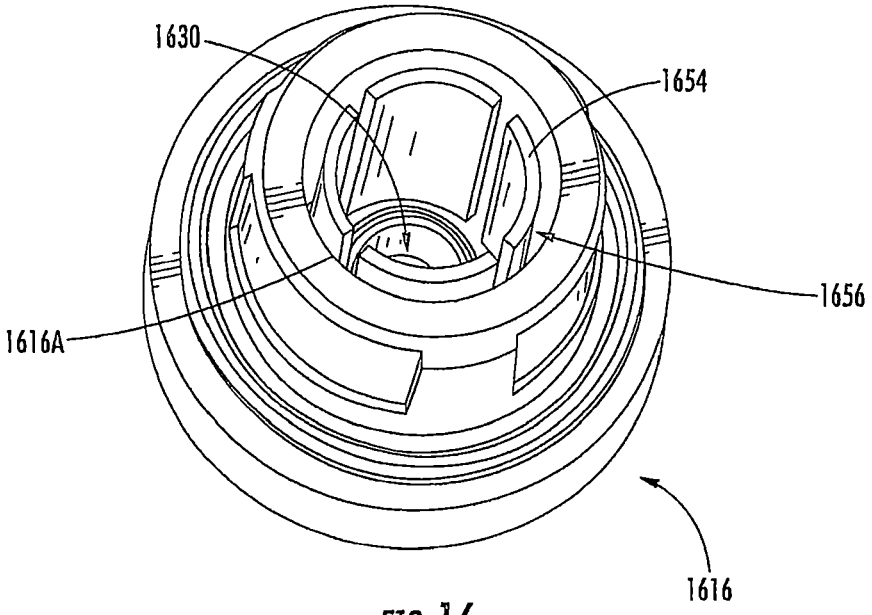

FIG. 16 illustrates a mouthpiece with a plurality of flutes substantially in the shape of a ring and a gap between the plurality of flutes and a wall of the mouthpiece according to another example embodiment of the present disclosure.

DETAILED DESCRIPTION

The present disclosure will now be described more fully hereinafter with reference to exemplary embodiments thereof. These exemplary embodiments are described so that this disclosure will be thorough and complete, and will fully convey the scope of the disclosure to those skilled in the art. Indeed, the disclosure may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural variations unless the context clearly dictates otherwise.

The present disclosure provides descriptions of aerosol delivery devices. The aerosol delivery devices may use electrical energy to heat a material (preferably without combusting the material to any significant degree) to form an inhalable substance; such articles most preferably being sufficiently compact to be considered "hand-held" devices. An aerosol delivery device may provide some or all of the sensations (e.g., inhalation and exhalation rituals, types of tastes or flavors, organoleptic effects, physical feel, use rituals, visual cues such as those provided by visible aerosol, and the like) of smoking a cigarette, cigar, or pipe, without any substantial degree of combustion of any component of that article or device. The aerosol delivery device may not produce smoke in the sense of the aerosol resulting from by-products of combustion or pyrolysis of tobacco, but rather, that the article or device most preferably yields vapors (including vapors within aerosols that can be considered to be visible aerosols that might be considered to be described as smoke-like) resulting from volatilization or vaporization of certain components of the article or device, although in other embodiments the aerosol may not be visible. In highly preferred embodiments, aerosol delivery devices may incorporate tobacco and/or components derived from tobacco. As such, the aerosol delivery device can be characterized as an electronic smoking article such as an electronic cigarette or "e-cigarette."

While the present disclosure is generally directed to aerosol delivery devices such as so-called "e-cigarettes," it should be understood that the mechanisms, components, features, and methods may be embodied in many different forms and associated with a variety of articles. For example, the description provided herein may be employed in conjunction with embodiments of traditional smoking articles (e.g., cigarettes, cigars, pipes, etc.) and heat-not-burn cigarettes. Accordingly, it should be understood that the description of the mechanisms, components, features, and methods disclosed herein are discussed in terms of embodiments relating to aerosol delivery mechanisms by way of example only, and may be embodied and used in various other products and methods.

Aerosol delivery devices of the present disclosure also can be characterized as being vapor-producing articles or medicament delivery articles. Thus, such articles or devices can be adapted so as to provide one or more substances (e.g., flavors and/or pharmaceutical active ingredients) in an inhalable form or state. For example, inhalable substances can be substantially in the form of a vapor (i.e., a substance that is in the gas phase at a temperature lower than its critical point). Alternatively, inhalable substances can be in the form of an aerosol (i.e., a suspension of fine solid particles or liquid droplets in a gas). For purposes of simplicity, the term "aerosol" as used herein is meant to include vapors, gases and aerosols of a form or type suitable for human inhalation, whether or not visible, and whether or not of a form that might be considered to be smoke-like.

In use, aerosol delivery devices of the present disclosure may be subjected to many of the physical actions employed by an individual in using a traditional type of smoking article (e.g., a cigarette, cigar or pipe that is employed by lighting and inhaling tobacco). For example, the user of an aerosol delivery device of the present disclosure can hold that article much like a traditional type of smoking article, draw on one end of that article for inhalation of aerosol produced by that article, take puffs at selected intervals of time, etc.

Aerosol delivery devices of the present disclosure generally include a number of components provided within an outer shell or body. The overall design of the outer shell or body can vary, and the format or configuration of the outer body that can define the overall size and shape of the aerosol delivery device can vary. Typically, an elongated body resembling the shape of a cigarette or cigar can be a formed from a single, unitary shell; or the elongated body can be formed of two or more separable pieces. For example, an aerosol delivery device can comprise an elongated shell or body that can be substantially tubular in shape and, as such, resemble the shape of a conventional cigarette or cigar. However, various other shapes and configurations may be employed in other embodiments (e.g., rectangular or fob-shaped).

In one embodiment, all of the components of the aerosol delivery device are contained within one outer body or shell. Alternatively, an aerosol delivery device can comprise two or more shells that are joined and are separable. For example, an aerosol delivery device can possess at one end a control body comprising a shell containing one or more reusable components (e.g., a rechargeable battery and various electronics for controlling the operation of that article), and at the other end and removably attached thereto a shell containing a disposable portion (e.g., a disposable flavor-containing cartridge). More specific formats, configurations and arrangements of components within the single shell type of unit or within a multi-piece separable shell type of unit will be evident in light of the further disclosure provided herein. Additionally, various aerosol delivery device designs and component arrangements can be appreciated upon consideration of the commercially available electronic smoking articles.

Aerosol delivery devices of the present disclosure most preferably comprise some combination of a power source (i.e., an electrical power source), at least one control component (e.g., means for actuating, controlling, regulating and/or ceasing power for heat generation, such as by controlling electrical current flow from the power source to other components of the aerosol delivery device), a heater or heat generation component (e.g., an electrical resistance heating element or component commonly referred to as part of an "atomizer"), and an aerosol precursor composition (e.g., commonly a liquid capable of yielding an aerosol upon application of sufficient heat, such as ingredients commonly referred to as "smoke juice," "e-liquid" and "e-juice"), and a mouthend region or tip for allowing draw upon the aerosol delivery device for aerosol inhalation (e.g., a defined air flow path through the article such that aerosol generated can be withdrawn therefrom upon draw).

Alignment of the components within the aerosol delivery device of the present disclosure can vary. In specific embodiments, the aerosol precursor composition can be located near an end of the aerosol delivery device which may be configured to be positioned proximal to the mouth of a user so as to maximize aerosol delivery to the user. Other configurations, however, are not excluded. Generally, the heating element can be positioned sufficiently near the aerosol precursor composition so that heat from the heating element can volatilize the aerosol precursor (as well as one or more flavorants, medicaments, or the like that may likewise be provided for delivery to a user) and form an aerosol for delivery to the user. When the heating element heats the aerosol precursor composition, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof, wherein such terms are also interchangeably used herein except where otherwise specified.

As noted above, the aerosol delivery device may incorporate a battery or other electrical power source (e.g., a capacitor) to provide current flow sufficient to provide various functionalities to the aerosol delivery device, such as powering of a heater, powering of control systems, powering of indicators, and the like. The power source can take on various embodiments. Preferably, the power source is able to deliver sufficient power to rapidly heat the heating element to provide for aerosol formation and power the aerosol delivery device through use for a desired duration of time. The power source preferably is sized to fit conveniently within the aerosol delivery device so that the aerosol delivery device can be easily handled. Additionally, a preferred power source is of a sufficiently light weight to not detract from a desirable smoking experience.

More specific formats, configurations and arrangements of components within the aerosol delivery device of the present disclosure will be evident in light of the further disclosure provided hereinafter. Additionally, the selection of various aerosol delivery device components can be appreciated upon consideration of the commercially available electronic aerosol delivery devices. Further, the arrangement of the components within the aerosol delivery device can also be appreciated upon consideration of the commercially available electronic aerosol delivery devices.

One example embodiment of an aerosol delivery device 100 is illustrated in FIG. 1. In particular, FIG. 1 illustrates an aerosol delivery device 100 including a control body 200 and a cartridge 300. The control body 200 and the cartridge 300 can be permanently or detachably aligned in a functioning relationship. Various mechanisms may connect the cartridge 300 to the control body 200 to result in a threaded engagement, a press-fit engagement, an interference fit, a magnetic engagement, or the like. The aerosol delivery device 100 may be substantially rod-like, substantially tubular shaped, or substantially cylindrically shaped in some embodiments when the cartridge 300 and the control body 200 are in an assembled configuration. However, various other configurations such as rectangular or fob-shaped may be employed in other embodiments.

In specific embodiments, one or both of the cartridge 300 and the control body 200 may be referred to as being disposable or as being reusable. For example, the control body 200 may have a replaceable battery or a rechargeable battery and/or capacitor and thus may be combined with any type of recharging technology, including connection to a typical alternating current electrical outlet, connection to a car charger (i.e., cigarette lighter receptacle), and connection to a computer, such as through a universal serial bus (USB) cable. Further, in some embodiments the cartridge 300 may comprise a single-use cartridge, as disclosed in U.S. Pat. No. 8,910,639 to Chang et al., which is incorporated herein by reference in its entirety.

FIG. 2 illustrates an exploded view of the control body 200 of the aerosol delivery device 100 (see, FIG. 1) according to an example embodiment of the present disclosure. As illustrated, the control body 200 may comprise a coupler 202, an outer body 204, a sealing member 206, an adhesive member 208 (e.g., KAPTON® tape), a flow sensor 210 (e.g., a puff sensor or pressure switch), a control component 212, a spacer 214, an electrical power source 216 (e.g., a battery, which may be rechargeable), a circuit board with an indicator 218 (e.g., a light emitting diode (LED)), a connector circuit 220, and an end cap 222. Examples of electrical power sources are described in U.S. Pat. App. Pub. No. 2010/0028766 by Peckerar et al., the disclosure of which is incorporated herein by reference in its entirety.

With respect to the flow sensor 210, representative current regulating components and other current controlling components including various microcontrollers, sensors, and switches for aerosol delivery devices are described in U.S. Pat. No. 4,735,217 to Gerth et al., U.S. Pat. Nos. 4,922,901, 4,947,874, and 4,947,875, all to Brooks et al., U.S. Pat. No. 5,372,148 to McCafferty et al., U.S. Pat. No. 6,040,560 to Fleischhauer et al., U.S. Pat. No. 7,040,314 to Nguyen et al., and U.S. Pat. No. 8,205,622 to Pan, all of which are incorporated herein by reference in their entireties. Reference also is made to the control schemes described in U.S. App. Pub. No. 2014/0270727 to Ampolini et al., which is incorporated herein by reference in its entirety.

In one embodiment the indicator 218 may comprise one or more light emitting diodes. The indicator 218 can be in communication with the control component 212 through the connector circuit 220 and be illuminated, for example, during a user drawing on a cartridge coupled to the coupler 202, as detected by the flow sensor 210. The end cap 222 may be adapted to make visible the illumination provided thereunder by the indicator 218. Accordingly, the indicator 218 may be illuminated during use of the aerosol delivery device 100 to simulate the lit end of a smoking article. However, in other embodiments the indicator 218 can be provided in varying numbers and can take on different shapes and can even be an opening in the outer body (such as for release of sound when such indicators are present).

Still further components can be utilized in the aerosol delivery device of the present disclosure. For example, U.S. Pat. No. 5,154,192 to Sprinkel et al. discloses indicators for smoking articles; U.S. Pat. No. 5,261,424 to Sprinkel, Jr. discloses piezoelectric sensors that can be associated with the mouth-end of a device to detect user lip activity associated with taking a draw and then trigger heating of a heating device; U.S. Pat. No. 5,372,148 to McCafferty et al. discloses a puff sensor for controlling energy flow into a heating load array in response to pressure drop through a mouthpiece; U.S. Pat. No. 5,967,148 to Harris et al. discloses receptacles in a smoking device that include an identifier that detects a non-uniformity in infrared transmissivity of an inserted component and a controller that executes a detection routine as the component is inserted into the receptacle; U.S. Pat. No. 6,040,560 to Fleischhauer et al. describes a defined executable power cycle with multiple differential phases; U.S. Pat. No. 5,934,289 to Watkins et al. discloses photonic-optronic components; U.S. Pat. No. 5,954,979 to Counts et al. discloses means for altering draw resistance through a smoking device; U.S. Pat. No. 6,803,545 to Blake et al. discloses specific battery configurations for use in smoking devices; U.S. Pat. No. 7,293,565 to Griffen et al. discloses various charging systems for use with smoking devices; U.S. Pat. No. 8,402,976 to Fernando et al. discloses computer interfacing means for smoking devices to facilitate charging and allow computer control of the device; U.S. Pat. No. 8,689,804 to Fernando et al. discloses identification systems for smoking devices; and WO2010/003480 by Flick discloses a fluid flow sensing system indicative of a puff in an aerosol generating system; all of the foregoing disclosures being incorporated herein by reference in their entireties. Further examples of components related to electronic aerosol delivery articles and disclosing materials or components that may be used in the present article include U.S. Pat. No. 4,735,217 to Gerth et al.; U.S. Pat. No. 5,249,586 to Morgan et al.; U.S. Pat. No. 5,666,977 to Higgins et al.; U.S. Pat. No. 6,053,176 to Adams et al.; U.S. Pat. No. 6,164,287 to White; U.S. Pat. No. 6,196,218 to Voges; U.S. Pat. No. 6,810,883 to Felter et al.; U.S. Pat. No. 6,854,461 to Nichols; U.S. Pat. No. 7,832,410 to Hon; U.S. Pat. No. 7,513,253 to Kobayashi; U.S. Pat. No. 7,896,006 to Hamano; U.S. Pat. No. 6,772,756 to Shayan; U.S. Pat. Nos. 8,156,944 and 8,375,957 to Hon; U.S. Pat. No. 8,794,231 to Thorens et al.; U.S. Pat. No. 8,851,083 to Oglesby et al.; U.S. Pat. Nos. 8,915,254 and 8,925,555 to Monsees et al.; and U.S. Pat. No. 9,220,302 to DePiano et al.; U.S. Pat. App. Pub. Nos. 2006/0196518 and 2009/0188490 to Hon; U.S. Pat. App. Pub. No. 2010/0024834 to Oglesby et al.; U.S. Pat. App. Pub. No. 2010/0307518 to Wang; WO2010/091593 to Hon; and WO2013/089551 to Foo, each of which is incorporated herein by reference in its entirety. A variety of the materials disclosed by the foregoing documents may be incorporated into the present devices in various embodiments, and all of the foregoing disclosures are incorporated herein by reference in their entireties.

FIG. 3 illustrates the cartridge 300 in an exploded configuration. As illustrated, the cartridge 300 may comprise a base 302, a control component terminal 304, an electronic control component 306, a flow director 308, an atomizer 310, a reservoir such as a container and/or a reservoir substrate 312, an outer body 314, a mouthpiece 316, a label 318, and first and second heating terminals 320*a*, 320*b* according to an example embodiment of the present disclosure.

In some embodiments the first and second heating terminals 320*a*, 320*b* may be embedded in, or otherwise coupled to, the flow director 308. For example, the first and second heating terminals 320*a*, 320*b* may be insert molded in the flow director 308. Accordingly, the flow director 308 and the first and second heating terminals may be collectively referred to as a flow director assembly 322. Additional description with respect to the first and second heating terminals 320*a*, 320*b* and the flow director 308 is provided in U.S. Pat. Pub. No. 2015/0335071 to Brinkley et al., which is incorporated herein by reference in its entirety.

The atomizer 310 may comprise a liquid transport element 324 and a heating element 326. The cartridge may additionally include a base shipping plug engaged with the base and/or a mouthpiece shipping plug engaged with the mouthpiece in order to protect the base and the mouthpiece and prevent entry of contaminants therein prior to use as disclosed, for example, in U.S. Pat. No. 9,220,302 to Depiano et al., which is incorporated herein by reference in its entirety.

The base 302 may be coupled to a first end of the outer body 314, and the mouthpiece 316 may be coupled to an opposing second end of the outer body to substantially or fully enclose other components of the cartridge 300 therein. For example, the control component terminal 304, the electronic control component 306, the flow director 308, the atomizer 310, and the reservoir substrate 312 may be substantially or entirely retained within the outer body 314. The mouthpiece 316 may be integrated with the outer body 314 as a unitary construction. The label 318 may at least partially surround the outer body 314, and optionally the base 302, and include information such as a product identifier thereon. The base 302 may be configured to engage the coupler 202 of the control body 200 (see, e.g., FIG. 2). In some embodiments the base 302 may comprise anti-rotation features that substantially prevent relative rotation between the cartridge and the control body as disclosed in U.S. Pat. App. Pub. No. 2014/0261495 to Novak et al., which is incorporated herein by reference in its entirety.

The reservoir substrate 312 may be configured to hold an aerosol precursor composition. The aerosol precursor composition, also referred to as a vapor precursor composition, may comprise a variety of components including, by way of example, a polyhydric alcohol (e.g., glycerin, propylene glycol, or a mixture thereof), water, and/or flavorants. In some embodiments, the aerosol precursor composition may include compounds that provide a specific effect. Such compounds may include medicaments or other like agents.

For aerosol delivery systems that are characterized as electronic cigarettes, the aerosol precursor composition most preferably incorporates tobacco or components derived from tobacco. In one regard, the tobacco may be provided as parts or pieces of tobacco, such as finely ground, milled or powdered tobacco lamina. In another regard, the tobacco may be provided in the form of an extract, such as a spray dried extract that incorporates many of the water soluble components of tobacco. Alternatively, tobacco extracts may have the form of relatively high nicotine content extracts, which extracts also incorporate minor amounts of other extracted components derived from tobacco. In another regard, components derived from tobacco may be provided in a relatively pure form, such as certain flavoring agents that are derived from tobacco (including nicotine in an essentially pure form).

Further to the above, an aerosol precursor composition may include one or more nicotinic compounds, including but not limited to nicotine in free base form, salt form, as a complex, or as a solvate. See, for example, the discussion of nicotine in free base form in US Pat. Pub. No. 2004/0191322 to Hansson, which is incorporated herein by reference. At least a portion of the nicotinic compound can be employed in the form of a resin complex of nicotine, where nicotine is bound in an ion exchange resin, such as nicotine polacrilex. See, for example, U.S. Pat. No. 3,901,248 to Lichtneckert et al., which is incorporated herein by reference. At least a portion of the nicotine can be employed in the form of a salt Salts of nicotine can be provided using the types of ingredients and techniques set forth in U.S. Pat. No. 2,033,909 to Cox et al. and U.S. Pat. No. 4,830,028 to Lawson et al., and Perfetti, Beitrage Tabakforschung Int., 12: 43-54(1983), which are incorporated herein by reference. See, also, U.S. patent application Ser. No. 12/769,335 to Brinkley et al, filed Apr. 28, 2010, which is incorporated herein by reference. Additionally, salts of nicotine have been available from sources such as Pfaltz and Bauer, Inc. and K&K Laboratories, Division of ICN Biochemicals, Inc. Specific, non-limiting examples of nicotinic compounds that can be useful are disclosed in U.S. Pat. Pub. No. 2013/0098377 to Borschke et al. and 2017/0007594 to Borschke, which are incorporated herein by reference. Examples of nicotine salts that can be useful are disclosed in US. Pat. Pub. No, 2016/0185750 to Dull et al., which is incorporated herein by reference.

In some embodiments, β-nicotyrine and/or other minor nicotinic alkaloids (e.g., including, but not limited to, nornicotine, myosmine, anabasine, anatabine, isonicotine, and combinations thereof) are incorporated within e-liquids containing nicotine. β-nicotyrine is an oxidation product of nicotine and, thus, e-liquids containing nicotine may inherently contain some amount of β-nicotyrine. In certain embodiments, it may be advantageous to supplement e-liquids with additional β-nicotyrine and/or other minor nicotinic alkaloids to achieve a concentration above that naturally occurring as a result of typical nicotine oxidation. During use, electronic cigarettes aerosolize both nicotine and β-nicotyrine, delivering a combination of these compounds to the user. Although not intending to be limited by theory, it is believed that, following delivery of these compounds, β-nicotyrine may inhibit nicotine metabolism, maintaining plasma nicotine levels for a longer period of time. As such, smaller doses of nicotine could be effective in sustaining satisfying nicotine levels and, in some embodiments, the inclusion of β-nicotyrine and/or other minor nicotinic alkaloids in the liquid may allow for lower nicotine concentration therein. See, for example, Abramovitz et al., Med. Hypothesis 85(2015) 305-310, which is incorporated herein by reference.

Other active agents (e.g., caffeine) can also be suitable for inclusion in an aerosol precursor composition. Examples of drugs that can be vaporized from a heated surface to form a high purity aerosol are described in U.S. Pat. No. 7,581,540 to Hale et al., which is incorporated herein by reference.

Representative types of aerosol precursor components and formulations are also set forth and characterized in U.S. Pat. No. 7,726,320 to Robinson et al.; U.S. Pat. No. 8,881,737 to Collett et al.; and U.S. Pat. No. 9,254,002 to Chong et al., and U.S. Pat. Pub. No. 2013/0008457 to Zheng et al.; 2015/0020823 to Lipowicz et al.; and 2015/0020830 to Koller, as well as WO2014/182736 to Bowen et al, the disclosures of which are incorporated herein by reference. Other aerosol precursors that may be employed include the aerosol precursors that have been incorporated in the VUSE® product by R. J. Reynolds Vapor Company, the BLU product by Lorillard Technologies, the MISTIC MENTHOL product by Mistic Ecigs, and the VYPE product by CN Creative Ltd. Also desirable are the so-called "smoke juices" for electronic cigarettes that have been available from Johnson Creek Enterprises LLC. Embodiments of effervescent materials can be used with the aerosol precursor, and are described, by way of example, in U.S. Pat. App. Pub. No. 2012/0055494 to Hunt et al., which is incorporated herein by reference. Further, the use of effervescent materials is described, for example, in U.S. Pat. No. 4,639,368 to Niazi et al.; U.S. Pat. No. 5,178,878 to Wehling et al.; U.S. Pat. No. 5,223,264 to Wehling et al.; U.S. Pat. No. 6,974,590 to Pather et al.; U.S. Pat. No. 7,381,667 to Bergquist et al.; U.S. Pat. No. 8,424,541 to Crawford et al; and U.S. Pat. No. 8,627,828 to Strickland et al.; as well as US Pat. Pub. No. 2010/0018539 to Brinkley et al. and 2010/0170522 to Sun et al.; and PCT WO97/06786 to Johnson et al., all of which are incorporated by reference herein.

The reservoir substrate 312 may comprise a plurality of layers of nonwoven fibers formed into the shape of a tube encircling the interior of the outer body 314 of the cartridge 300. Thus, liquid components, for example, can be sorptively retained by the reservoir substrate 312. The reservoir substrate 312 is in fluid connection with the liquid transport element 324. Thus, the liquid transport element 324 may be configured to transport liquid from the reservoir substrate 312 to the heating element 326 via capillary action or other liquid transport mechanisms.

As illustrated, the liquid transport element 324 may be in direct contact with the heating element 326. As further illustrated in FIG. 3, the heating element 326 may comprise a wire defining a plurality of coils wound about the liquid transport element 324. In some embodiments the heating element 326 may be formed by winding the wire about the liquid transport element 324 as described in U.S. Pat. No. 9,210,738 to Ward et al., which is incorporated herein by reference in its entirety. Further, in some embodiments the wire may define a variable coil spacing, as described in U.S. Pat. App. Pub. No. 2014/0270730 to DePiano et al., which is incorporated herein by reference in its entirety. Various embodiments of materials configured to produce heat when electrical current is applied therethrough may be employed to form the heating element 326. Example materials from which the wire coil may be formed include Kanthal (FeCrAl), Nichrome, Molybdenum disilicide ($MoSi_2$), molybdenum silicide (MoSi), Molybdenum disilicide doped with Aluminum ($Mo(Si,Al)_2$), titanium, platinum, silver, palladium, graphite and graphite-based materials; and ceramic (e.g., a positive or negative temperature coefficient ceramic).

However, various other embodiments of methods may be employed to form the heating element 326, and various other embodiments of heating elements may be employed in the atomizer 310. For example, a stamped heating element may be employed in the atomizer, as described in U.S. Pat. App. Pub. No. 2014/0270729 to DePiano et al., which is incorporated herein by reference in its entirety. Further to the above, additional representative heating elements and materials for use therein are described in U.S. Pat. No. 5,060,671 to Counts et al.; U.S. Pat. No. 5,093,894 to Deevi et al.; U.S. Pat. No. 5,224,498 to Deevi et al.; U.S. Pat. No. 5,228,460 to Sprinkel Jr., et al.; U.S. Pat. No. 5,322,075 to Deevi et al.; U.S. Pat. No. 5,353,813 to Deevi et al.; U.S. Pat. No. 5,468,936 to Deevi et al.; U.S. Pat. No. 5,498,850 to Das; U.S. Pat. No. 5,659,656 to Das; U.S. Pat. No. 5,498,855 to Deevi et al.; U.S. Pat. No. 5,530,225 to Hajaligol; U.S. Pat. No. 5,665,262 to Hajaligol; U.S. Pat. No. 5,573,692 to Das et al.; and U.S. Pat. No. 5,591,368 to Fleischhauer et al., the disclosures of which are incorporated herein by reference in their entireties. Further, chemical heating may be employed in other embodiments. Various additional examples of heaters and materials employed to form heaters are described in U.S. Pat. No. 8,881,737 to Collett et al., which is incorporated herein by reference, as noted above.

A variety of heater components may be used in the present aerosol delivery device. In various embodiments, one or more microheaters or like solid state heaters may be used. Microheaters and atomizers incorporating microheaters suitable for use in the presently disclosed devices are described in U.S. Pat. No. 8,881,737 to Collett et al., which is incorporated herein by reference in its entirety.

The first heating terminal 320*a* and the second heating terminal 320*b*(e.g., negative and positive heating terminals) are configured to engage opposing ends of the heating element 326 and to form an electrical connection with the control body 200 (see, e.g., FIG. 2) when the cartridge 300 is connected thereto. Further, when the control body 200 is coupled to the cartridge 300, the electronic control component 306 may form an electrical connection with the control body through the control component terminal 304. The control body 200 may thus employ the electronic control component 212 (see, FIG. 2) to determine whether the cartridge 300 is genuine and/or perform other functions. Further, various examples of electronic control components and functions performed thereby are described in U.S. Pat. App. Pub. No. 2014/0096781 to Sears et al., which is incorporated herein by reference in its entirety.

Various other details with respect to the components that may be included in the cartridge 300, are provided, for example, in U.S. Pat. App. Pub. No. 2014/0261495 to DePiano et al., which is incorporated herein by reference in its entirety. In this regard, FIG. 7 thereof illustrates an enlarged exploded view of a base and a control component terminal; FIG. 8 thereof illustrates an enlarged perspective view of the base and the control component terminal in an assembled configuration; FIG. 9 thereof illustrates an enlarged perspective view of the base, the control component terminal, an electronic control component, and heating terminals in an assembled configuration; FIG. 10 thereof illustrates an enlarged perspective view of the base, the atomizer, and the control component in an assembled configuration; FIG. 11 thereof illustrates an opposing perspective view of the assembly of FIG. 10 thereof; FIG. 12 thereof illustrates an enlarged perspective view of the base, the atomizer, the flow director, and the reservoir substrate in an assembled configuration; FIG. 13 thereof illustrates a perspective view of the base and an outer body in an assembled configuration; FIG. 14 thereof illustrates a perspective view of a cartridge in an assembled configuration; FIG. 15 thereof illustrates a first partial perspective view of the cartridge of FIG. 14 thereof and a coupler for a control body; FIG. 16 thereof illustrates an opposing second partial perspective view of the cartridge of FIG. 14 thereof and the coupler of FIG. 15 thereof; FIG. 17 thereof illustrates a perspective view of a cartridge including a base with an anti-rotation mechanism; FIG. 18 thereof illustrates a perspective view of a control body including a coupler with an anti-rotation mechanism; FIG. 19 thereof illustrates alignment of the cartridge of FIG. 17 with the control body of FIG. 18; FIG. 20 thereof illustrates an aerosol delivery device comprising the cartridge of FIG. 17 thereof and the control body of FIG. 18 thereof with a modified view through the aerosol delivery device illustrating the engagement of the anti-rotation mechanism of the cartridge with the anti-rotation mechanism of the connector body; FIG. 21 thereof illustrates a perspective view of a base with an anti-rotation mechanism; FIG. 22 thereof illustrates a perspective view of a coupler with an anti-rotation mechanism; and FIG. 23 thereof illustrates a sectional view through the base of FIG. 21 thereof and the coupler of FIG. 22 thereof in an engaged configuration. Various other details with respect to the components that may be included in the cartridge 300, are provided, for example, in U.S. Pat. Pub. No. 2015/0335071 to Brinkley et al., filed May 23, 2014, which is incorporated herein by reference in its entirety.

Various components of an aerosol delivery device according to the present disclosure can be chosen from components described in the art and commercially available. Reference is made for example to the reservoir and heater system for controllable delivery of multiple aerosolizable materials in an electronic smoking article disclosed in U.S. Pat. App. Pub. No. 2014/0000638 to Sebastian et al., which is incorporated herein by reference in its entirety.

In another embodiment substantially the entirety of the cartridge may be formed from one or more carbon materials, which may provide advantages in terms of biodegradability and absence of wires. In this regard, the heating element may comprise carbon foam, the reservoir substrate may comprise carbonized fabric, and graphite may be employed to form an electrical connection with the power source and control component. An example embodiment of a carbon-based cartridge is provided in U.S. Pat. App. Pub. No. 2013/0255702 to Griffith et al., which is incorporated herein by reference in its entirety.

During use, a user may draw on the mouthpiece 316 of the cartridge 300 of the aerosol delivery device 100 (see, FIG. 1). This may pull air through an opening in the control body 200 (see, e.g., FIG. 2) or in the cartridge 300. For example, in one embodiment an opening may be defined between the coupler 202 and the outer body 204 of the control body 200 (see, e.g., FIG. 2), as described in U.S. Pat. No. 9,220,302 to DePiano et al., which is incorporated herein by reference in its entirety. However, the flow of air may be received through other parts of the aerosol delivery device 100 in other embodiments. As noted above, in some embodiments the cartridge 300 may include the flow director 308. The flow director 308 may be configured to direct the flow of air received from the control body 200 to the heating element 326 of the atomizer 310.

A sensor in the aerosol delivery device 100 (e.g., the flow sensor 210 in the control body 200) may sense the puff. When the puff is sensed, the control body 200 may direct current to the heating element 326 through a circuit including the first heating terminal 320*a* and the second heating terminal 320*b*. Accordingly, the heating element 326 may vaporize the aerosol precursor composition directed to an aerosolization zone from the reservoir substrate 312 by the liquid transport element 324. In this regard, components of the aerosol delivery device 100 (see, FIG. 1) including at least a reservoir (e.g., the reservoir substrate 312) configured to contain an aerosol precursor composition and an atomizer (e.g., the atomizer 310) may be referred to as an aerosol production assembly. The mouthpiece 316 may allow passage of air and entrained vapor (i.e., the components of the aerosol precursor composition in an inhalable form) from the cartridge 300 through an outlet 328 (see, FIG. 4) to a consumer drawing thereon.

Accordingly, when a user draws on the aerosol delivery device 100 (see, FIG. 1), his or her lips may contact a portion thereof, such as the mouthpiece 316, label 318 or outer body 314. Further, when the user draws on the aerosol delivery device 100, aerosol may be produced inside the aerosol delivery device and directed to the user. However, operation in this manner may result in certain problems.

For example, the liquid aerosol precursor composition arriving at the aerosolization zone from the reservoir substrate 312 with each draw on the mouthpiece 316 may not be completely vaporized. The air pulled through the mouthpiece 316 may draw aerosol precursor that remains in the form of liquid droplets out of the aerosol delivery device 100, resulting in a less satisfactory user experience.

In another example, from time to time, aerosol may condense back to a liquid droplet form prior to exiting the aerosol delivery device 100 through the outlet 328 of the mouthpiece 316. This condensed liquid, generally in the form of droplets, may then be pulled from the outlet 328 while the user draws upon the mouthpiece 316, or may otherwise exit from the outlet 328 or other aperture between draws upon the aerosol delivery device 100. Such droplets may undesirably contact surrounding structures, such as a user's pocket when received therein. Further, the liquid droplets are wasted, rather than delivered to the user as an aerosol. This may reduce the efficiency of delivery of aerosol to the user and/or the condensed aerosol may be received by the user in liquid form, which may affect the taste or other sensory characteristics associated with using the aerosol delivery device.

Accordingly, embodiments of the present disclosure may include features configured to address the above-noted problems. In this regard, FIG. 4 illustrates a partial sectional view through the cartridge 300. As illustrated, in one embodiment air 402 may flow through the flow director 308 past the atomizer 310. At least a portion of the air 402 may combine with vapor produced at the atomizer 310 to form aerosol 404, which exits through the outlet 328 of the mouthpiece 316. The outlet 328 may be formed at the downstream end of a lumen 330 formed in the mouthpiece 316. The lumen 330 may be tapered as shown in FIG. 4 or may be substantially cylindrical. The shape and configuration of the mouthpiece 316 is not particularly limited. The mouthpiece may be integral with a mouth end of the outer body 314. The mouthpiece may be a cap inserted at least partially into outer body 314 at the mouth end. In other embodiments the mouthpiece 316 may be fit over the exterior of the outer body 314 at the mouth end thereof.

The portions of the aerosol delivery device 100 (see, FIG. 1) most likely to be subjected to condensation formation from the aerosol include those surfaces surrounding and downstream of the atomizer 310 in terms of a flow path through the aerosol delivery device 100 which travels past the atomizer and exits the aerosol delivery device through the outlet 328. For example, aerosol may condense at one or more inner surfaces 316A of the mouthpiece 316, such as along the lumen 330, and/or one or more inner surfaces 314A of the outer body 314 as shown in FIG. 4. FIG. 4 shows one configuration of a mouthpiece 316 with a tapered, funnel shaped lumen. The shape of the lumen 330 is not particularly limited. Mouthpieces with cylindrical shaped lumen are discussed further below.

Accordingly, embodiments the aerosol delivery device 100 (see, FIG. 1) may include features at the inner surfaces 316A of the mouthpiece 316 and/or the inner surfaces 314A of the outer body 314 configured to limit the ability for liquid droplets to exit the mouthpiece 316.

Some embodiments of the present disclosure are directed to an aerosol delivery device including a surface with engineered hydrophobic properties. In other words, the surface can include three-dimensional structures, imparting hydrophobic characteristics to the surface.

Particularly, the surface of the aerosol delivery device may comprise a micro-pattern. In this regard, a micro-pattern can refer to an engineered surface topography including ordered three-dimensional features at the micrometer scale. Such a surface may be distinguished from inherent surface features of objects at least on the basis of the three-dimensional pattern being specifically, intentionally formed to define the ordered pattern at the micro-meter scale. As described below, in some embodiments the micro-pattern may comprise a biomimicry micro-pattern configured to mimic the surface topography of certain surfaces of natural organisms that provide hydrophobic properties, which further distinguishes the present micro-patterns from inherent surface topographies of objects.

The micro-pattern can exhibit a variety of geometries (e.g., pillars, channels, platelets, cones, divots, etc.) and can be specifically engineered with a defined roughness, which can provide specific fluid flow responses. The micro-pattern can be substantially constant (e.g., exhibiting a single, repeating feature of substantially unchanging dimensions) and/or can exhibit a substantially repeating pattern (e.g., a plurality of features differing in one or more of size, shape, and spacing, that define an ordered, repeating pattern). The micro-pattern may be defined at least in part in relation to the size and/or spacing of the geometric elements forming the micro-pattern. For example, the geometric elements can have an average height of about 1 μm to about 500 μm, about 1.5 μm to about 250 μm, about 2 μm to about 100 μm, about 2.5 μm to about 50 μm, or about 3 μm to about 25 μm. The geometric elements can have an average spacing of about 0.1 μm to about 20 μm, about 0.25 μm to about 15 μm, about 0.5 μm to about 10 μm, or about 1 μm to about 5 μm. Usage of a surface having a micro-pattern so as to be hydrophobic may resist the formation of condensation thereon, thereby addressing the above-noted issues with respect to liquid carry over.

As noted above, a surface may be provided with a micro-pattern to impart hydrophobic properties thereto. The surface including the micro-pattern may be positioned at an inner surface of the aerosol delivery device. For example, the surface including a micro-pattern may be provided at the inner surface(s) 316A of the mouthpiece 316, such as along at least a portion of the lumen 330, and/or at the inner surface(s) 314A of the outer body 314. Accordingly, the surface including a micro-pattern may be positioned at the surfaces noted above at which condensing of the aerosol may occur.

Various embodiments of surfaces including a micro-pattern may be employed. In one or more embodiments, however, it can be desirable for the micro-pattern to substantially mimic a micro-pattern found in nature. In other words, the micro-pattern may be substantially engineered to replicate a natural, micro-scale topographical pattern or a biomimicry micro-pattern. As an example, sharkskin may be hydrophobic. Such water resistance may be provided at least in part by a topographical pattern on the skin defining a rough surface.

A microscopic image of sharkskin 500 is illustrated in FIG. 5. As illustrated, the sharkskin comprises a matrix of hard, tooth-like structures 502 called dermal denticles or placoid scales. The tooth-like structures 502 may define a pattern of diamond or parallelogram shapes 504 at the locations where the tooth-like structures are exposed. Each tooth-like structure 502 may include a plurality of raised parallel ribs 506 separated by recesses 508.

One embodiment of a surface including a micro-pattern 600 is illustrated in FIG. 6. The surface including a micro-pattern 600 may be employed at any of the surfaces of the aerosol delivery device 100 such as the surfaces particularly noted above that may be subject to condensation formation. As illustrated, the micro-pattern 600 is a biomimicry micro-pattern that is substantially a sharkskin micro-pattern. In this regard, the surface including a micro-pattern 600 may include a pattern of diamond or parallelogram shapes 604. The parallelograms 604 may define a width from about twenty micrometers to about thirty micrometers. Each parallelogram 604 may include a plurality of raised parallel ribs 606 separated by recesses 608. The ribs 606 may extend from about two micrometers to about four from micrometers outwardly from the recesses 608. Accordingly, the surface including a micro-pattern 600 defining the sharkskin micro-pattern may embody properties resembling those of natural sharkskin. Thus, for example, the surface including a micro-pattern 600 defining the sharkskin micro-pattern may provide hydrophobic properties. Example embodiments of products including a sharkskin micro-pattern are available from Sharklet Technologies, Inc. of Aurora, Colo. Surface topographies suitable for use as a micro-pattern according to embodiments of the present disclosure are described in U.S. Pat. No. 8,997,672 to Brennan et al., which is incorporated herein by reference in its entirety.

Various other embodiments of surfaces including a micro-pattern may be employed. In this regard, the lotus leaf defines superhydrophobic properties, which may resist the buildup of water and matter thereon. The superhydrophobic properties are provided in part by an epicuticular wax. However, the superhydrophobic properties may be additionally provided by the structure of the surface thereof. In this regard, FIG. 7 is a scanning electron microscope (SEM) image of a lotus leaf 700 at scales of five micrometers and fifty micrometers. As illustrated, the lotus leaf 700 may include a plurality of papillae 702. The papillae 702 may define a height from about ten to about twenty micrometers and a width from about ten to about fifteen micrometers.

FIG. 8 is a scanning electron microscope image of an additional embodiment of a surface including a micro-pattern 800 at scales of five micrometers and fifty micrometers. As illustrated, the micro-pattern 800 is a biomimicry micro-pattern that is substantially a lotus leaf micro-pattern. In this regard, the surface including a micro-pattern may include a plurality of protrusions 802 that mimic the size and shape of the papillae 702 of the lotus leaf 700 (see, FIG. 7). For example, the protrusions 802 may define a height from about ten to about twenty micrometers and a width from about ten to about fifteen micrometers. Additional description with respect to surfaces including a lotus leaf micro-pattern is provided in *Superhydrophobic Surfaces Developed by Mimicking Hierarchical Surface Morphology of Lotus Leaf* by Latthe et al., which is incorporated herein by reference in its entirety.

Accordingly, the surface including a micro-pattern 800 defining the lotus leaf micro-pattern may embody properties resembling those of a natural lotus leaf. Thus, for example, the surface including a micro-pattern 800 defining the lotus leaf micro-pattern may provide hydrophobic properties.

FIG. 9 is a scanning electron microscope image of an additional embodiment of a micro-pattern 900 at fifty-micrometer scale. As illustrated, the micro-pattern 900 comprises stacked circular pillars 902 with flutes 904. Each pillar 902 is approximately 35 microns in diameter. The pillars 902 may be spaced apart with a pitch of approximately 35 microns. The pillars may have a depth of approximately 45 microns. The illustrated micro-pattern 900 is designed to be superhydrophobic to inhibit droplet accumulation, thus preventing droplets from growing large enough to be inhaled through the outlet of the aerosol delivery device.

FIG. 10 is a scanning electron microscope image of an additional embodiment of a micro-pattern 1000 at fifty-micrometer scale. As illustrated, the micro-pattern 1000 comprises circular pillars 1002. Each pillar 1002 is approximately 100 microns in diameter. The pillars 1002 are spaced apart with a pitch of approximately 200 microns. The pillars 1002 have a depth of about 200 microns. The illustrated micro-pattern 1000 is designed to entrap any droplets of aerosol precursor that may condense on the surface, sometimes referred to as droplet pinning, to resist the droplets from being pulled toward the outlet of the aerosol delivery device during inhalation.

FIG. 11 shows a cross section of a mouthpiece 1116 with a micro-pattern 1132 in the form of a plurality of capillary channels 1134 along the lumen 1130. The capillary channels 1134 are sized and arranged to direct liquid away from the outlet 1128. Hemiwicking may occur along the capillary channels to direct any condensed fluid droplets away from the outlet 1128.

Repeating from above, embodiments the aerosol delivery device 100 (see, FIG. 1) may include features at the inner surfaces 316A of the mouthpiece 316 and the inner surfaces 314A of the outer body 314 that are configured to limit the ability for liquid droplets to exit the mouthpiece 316 through the outlet 328.

Accordingly, some embodiments of the present disclosure are directed to an aerosol delivery device including an absorptive component present in the region between the atomizer and the outlet to limit the ability for liquid droplets to exit the outlet. FIG. 12 shows the cross section of a mouthpiece 1216 for an aerosol delivery device according to examples of the current embodiment. An absorptive component 1236 may be placed into or along the lumen 1230 of the mouthpiece 1216, upstream of the outlet 1228. In other embodiments, portions of the absorptive component 1236 may additionally or alternatively be located at other inner surfaces of the mouthpiece 1216 or the outer shell (see, FIG. 4).

The absorptive component 1236 may be formed from bi-component fibers comprising a polyethylene (PE) sheath with a polyester core, or bi-component fibers comprising a polyester sheath with a polyester core. The fibers may be formed into a web, mat, or tow material with open-cells to increase surface area and promote absorption through capillarity. The fibers may be thermally bonded to one another to maintain the shape of the absorptive component. The absorptive component 1236 may alternatively be an open-cell foam made from polyethylene. In other embodiments, the absorptive component 1236 may be rolled or otherwise formed from a mat of cellulose acetate or other filter materials commonly known for use in smoking articles for filtering purposes. In one embodiment, the absorptive component 1236 may be formed from cellulose acetate combined with wood pulp and a polyvinyl alcohol (PVA) binder.

The absorptive component 1236 may be provided in the form of an insert placed at the desired location downstream of the atomizer within the aerosol delivery device 100. The absorptive component 1236 may be held in place with adhesive, thermal bonding, a friction fit, or other known methods in the art.

The absorptive component 1236 may have a tubular shape as shown in FIG. 12, providing an inner channel 1238 for the passage of air and aerosol. In another example embodiment, the absorptive component 1236 may have the shape of a cylindrical solid or otherwise substantially fill the lumen 1230 of the mouthpiece 1216 if the absorptive material is sufficiently porous to allow sufficient air and aerosol to exit the outlet 1228 with each draw. In another example embodiment, the absorptive component 1236 may take a disk shape positioned at an end 1240 of the mouthpiece 1216 opposite the outlet. Additional shapes and positions of the absorptive component within the aerosol delivery device, or attachments thereto, and downstream of the atomizer will be apparent to those of ordinary skill in the art. Further, those skilled in the art will appreciate that the absorptive component may comprise a plurality of absorptive components of various shapes and locations on the aerosol delivery device.

A mouthpiece 1316 is shown in FIG. 13 that is substantially similar to the mouthpiece 1216 in FIG. 12, but with the absorptive component removed. The absorptive component could be replaced by any of the micro-patterns discussed above formed along the inner surface 1316A of the mouthpiece 1316. Notably, the inner surface 1316A is shown as a cylindrical wall in the illustrated embodiment. The outlet 1328 of the mouthpiece 1316 is formed with an invert 1344 extending inwardly from the outlet, and spaced from the inner surface 1316A. The invert 1344 creates a chamber between the invert 1344 and the inner surface 1316A that helps to trap condensed aerosol and inhibit the condensed aerosol from exiting the outlet 1328. As illustrated, the chamber created by the invert 1344 essentially is in the form of a well surrounding at least a portion of the outlet 1328 of the mouthpiece 1316. The well (or depression) has a bottom wall that sits closer to the end of the mouthpiece 1316 than the internal opening into the outlet 1328 and can thus substantially prevent liquid from entering the internal opening into the outlet of the mouthpiece.

FIGS. 14-16 show additional embodiments of mouthpieces that have been molded or otherwise manufactured with structures within their respective lumen intended to reduce or prevent the unintended release of condensed aerosol from their respective outlets. As compared to the micro-patterning discussed above, the following embodiments may be described as having macro structures that may form condensation trapping chambers.

FIGS. 14 and 15 show mouthpieces 1416, 1516 formed with a plurality of grooves 1450, 1550 formed by continuous fins 1452, 1552 extending from the inner wall 1416A, 1516A toward a center of the lumen 1430, 1530. FIGS. 14 and 15 show embodiments with twelve and sixteen grooves 1450, 1550 respectively. While created at a macro-scale, the grooves 1450, 1550 are still expected to be sufficiently long and narrow to facilitate capillarity for any condensed aerosol. In addition, the grooves 1450, 1550 provide chambers intended to trap condensed aerosol.

FIG. 16 shows yet another mouthpiece 1616. The mouthpiece 1616 includes a plurality of flutes 1654 extending along the longitudinal axis of the lumen 1630. The plurality of flutes 1654 may be shaped and arranged to substantially form a ring concentric with the inner wall 1616A forming the lumen 1630. A gap 1656 formed between the inner wall 1616A and the ring of flutes 1654 may facilitate capillary action or provide a chamber for trapping condensed aerosol. Similarly, the spaces between the individual flutes 1654 may similarly trap condensed aerosol. The illustrated example includes four flutes 1654, but as few as a single ring-shaped flute may be used in some embodiments. In other embodiments, more than four flutes may be present.

Various embodiments of methods may be employed to create and use the aerosol delivery devices described herein. In one example method, one or more components of the aerosol delivery device 100 (see, FIG. 1) may be formed in a mold configured to define the surface including a micro-pattern. The mold may be etched (e.g., chemical, electrochemical, or laser etched) to define a surface configured to form the surface including a micro-pattern. Alternatively, the molded component may be etched to create the micro-pattern. Various other embodiments of methods for forming the surface including a micro-pattern may also be employed. For example, the surface including a micro-pattern may be produced by one or more methods such as self-assembly of a monolayer, photolithography, plasma polymerization, ultraviolet illumination, electrospinning, irradiation, template methods, chemical deposition, blasting (e.g., with sodium bicarbonate) followed by anodizing the blasted surface, and ablations. Various examples of such methods for producing surfaces including a micro-pattern are described in *Artificial Lotus Leaf Structures Made by Blasting with Sodium Bicarbonate* by Lee et al., which is incorporated herein by reference in its entirety.

The micro-patterned components may be formed from various polymers, glasses, ceramics, or other suitable materials.

Thus, various methods may be used for forming a micro-pattern as described herein. For example, patterning may be via an additive technique or a reductive technique. In an additive technique, a material may be deposited on the surface to form the pattern. The patterning material may be identical in composition to the thin film or may be of a different composition. In a reductive technique, a portion of the surface may be removed to form a series of grooves defining the micro-pattern. Non-limiting examples of patterning techniques that are encompassed by the present disclosure include nanoimprinting, photolithography, electron beam, ion beam, x-ray, self-assembly, lift-off, and similar patterning methods.

An example of a method of forming an aerosol delivery device may include providing an aerosol precursor composition. The method may additionally include positioning an atomizer in fluid communication with the aerosol precursor composition. Further, the method may include assembling the atomizer with a body, the body having an outlet, wherein the body is configured to minimize the ability for liquid droplets of the aerosol precursor to exit the outlet. Assembling the atomizer with the body may include positioning the body in fluid communication with the atomizer.

The method may further include forming the body including the micro-pattern. Additionally, forming the body may include forming the micro-pattern in a mold. The method may further include etching the mold. Alternatively, forming the body may include the addition of an absorptive component.

Additional methods of the present disclosure may include a method of minimizing waste of aerosol precursor during use of an aerosol delivery device. The method of minimizing waste may include drawing air past an atomizer and out of an aerosol delivery device through an outlet of a mouthpiece. The method may further include inhibiting droplets of the aerosol precursor from exiting the outlet of the mouthpiece. In some embodiments, inhibiting the droplets from exiting the outlet of the mouthpiece comprises absorbing the droplets in an absorptive component. In other embodiments, inhibiting the droplets from exiting the outlet comprises limiting droplet accumulation with a micro-patterned surface configured to be hydrophobic. In further embodiments, inhibiting the droplets from exiting the outlet comprises entrapping droplets on a micro-patterned surface.

Many modifications and other embodiments of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

The invention claimed is:

1. An aerosol delivery device comprising:

an atomizer comprising a liquid transport element and a heating element arranged to aerosolize an aerosol precursor composition;

a body having an outlet and housing the liquid transport element and the heating element, the outlet being arranged to receive suction and deliver the aerosolized aerosol precursor composition to a user in response thereto; and a micro-pattern comprising a plurality of capillary channels radially spaced apart and formed directly in one or both of an inner surface of the body and an inner surface of a mouthpiece defining the outlet of the body arranged downstream from the atomizer and upstream from the outlet relative to a flow direction of the aerosolized aerosol precursor composition and configured to inhibit liquid droplets of the aerosol precursor from exiting the outlet in response to the suction, the plurality of capillary channels each longitudinally extending from the outlet to convey liquid toward the liquid transport element and the heating element of the atomizer so as to direct liquid away from the outlet after the suction.

2. The aerosol delivery device of claim 1, wherein the micro-pattern is configured to entrap the liquid droplets along the surface.

3. The aerosol delivery device of claim 1, wherein the micro-pattern is formed by etching.

4. The aerosol delivery device of claim 1, wherein the micro-pattern is in the mouthpiece.

5. The aerosol delivery device of claim 1, wherein the mouthpiece comprises a plurality of flutes shaped and arranged to form a ring concentric with an inner surface of the mouthpiece to create the micro-pattern for inhibiting liquid droplets of the aerosol precursor from exiting the outlet.

6. The aerosol delivery device of claim 1, wherein the mouthpiece comprises an invert extending inwardly from the outlet, and spaced from an inner surface of the mouthpiece to create the micro-pattern for inhibiting liquid droplets of the aerosol precursor from exiting the outlet.

7. A method of forming an aerosol delivery device, the method comprising:

providing an aerosol precursor composition;

positioning an atomizer comprising a liquid transport element and a heating element in fluid communication with the aerosol precursor composition, the heating element being arranged to aerosolize an aerosol precursor composition;

forming a body having an outlet arranged to receive suction and deliver the aerosolized aerosol precursor composition to a user in response thereto and a micro-pattern comprising a plurality of capillary channels radially spaced apart and formed directly in one or both of an inner surface of the body and an inner surface of a mouthpiece defining the outlet of the body arranged downstream from the atomizer and upstream from the outlet relative to a flow direction of the aerosolized aerosol precursor composition, the plurality of capillary channels each longitudinally extending from the outlet to convey liquid toward the liquid transport element and the heating element of the atomizer so as to direct liquid away from the outlet after the suction; and assembling the atomizer with the body, wherein the body is configured to minimize an ability of liquid droplets of the aerosol precursor to exit the outlet in response to the suction.

8. The method of claim 7, wherein forming the body comprises molding the body with an etched mold.

9. A method of minimizing waste of an aerosol precursor composition during use of an aerosol delivery device, the method comprising:

drawing air past an atomizer comprising a liquid transport element and a heating element, and out of the aerosol delivery device through an outlet of a mouthpiece, the atomizer in fluid connection with the aerosol precursor composition and arranged to aerosolize an aerosol precursor composition; and inhibiting droplets of the aerosol precursor composition from exiting the outlet of the mouthpiece in response to the draw of air using a micro-pattern comprising a plurality of capillary channels radially spaced apart and formed directly in one or both of an inner surface of the body and an inner surface of the mouthpiece defining the outlet of the body and arranged downstream from the atomizer and upstream from the outlet relative to a flow direction of the aerosolized aerosol precursor composition, the plurality of capillary channels each longitudinally extending from the outlet to convey liquid toward the liquid transport element and the heating element of the atomizer so as to direct liquid away from the outlet of the aerosol delivery device after the draw of air.

10. The method of claim 9, wherein inhibiting the droplets from exiting comprises entrapping droplets on the micro-patterned surface.

* * * * *